US005267456A

United States Patent [19]

Nukaga et al.

[11] Patent Number: 5,267,456

[45] Date of Patent: Dec. 7, 1993

[54] DRUM-TYPE WASHING MACHINE

[75] Inventors: Tadashi Nukaga; Kentaro Mochizuki; Shinji Yamaguchi; Yoshikazu Banba, all of Shiga, Japan

[73] Assignee: Sanyo Electric Co., Ltd., Osaka, Japan

[21] Appl. No.: 708,902

[22] Filed: May 31, 1991

[30] Foreign Application Priority Data

Jun. 26, 1990 [JP] Japan ..... 2-167742

[51] Int. Cl.[5] ..... D06F 37/30

[52] U.S. Cl. ..... 68/12.24; 68/12.26; 68/139; 68/140; 74/411.5; 188/69

[58] Field of Search ..... 68/139, 140, 12.24, 68/12.26; 188/31, 60, 69, 82.7; 74/411.5

[56] References Cited

U.S. PATENT DOCUMENTS

| | | | |
|---|---|---|---|
| 1,023,731 | 4/1912 | Georgeff | 188/69 X |
| 1,718,191 | 6/1929 | Couch | 68/140 X |
| 1,991,803 | 2/1935 | Hubbell | 68/140 X |
| 2,072,764 | 3/1937 | McCoy | 188/69 X |
| 2,242,574 | 5/1941 | Floeter | 188/69 X |
| 2,727,380 | 12/1955 | Spreckelmeier | 68/140 |
| 3,295,649 | 1/1967 | Giuseppe . | |
| 3,856,119 | 12/1974 | Harrington | 188/827 X |

FOREIGN PATENT DOCUMENTS

| | | | |
|---|---|---|---|
| 521496 | 2/1956 | Canada | 68/140 |
| 253250 | 1/1988 | European Pat. Off. . | |
| 316670 | 5/1989 | European Pat. Off. . | |
| 337827 | 10/1989 | European Pat. Off. . | |
| 3310279 | 9/1984 | Fed. Rep. of Germany | 68/139 |
| 1535334 | 6/1968 | France . | |
| 2297946 | 8/1976 | France . | |
| 3311991 | 12/1988 | Japan | 68/139 |
| 1178291 | 1/1970 | United Kingdom . | |

*Primary Examiner*—Philip R. Coe
*Attorney, Agent, or Firm*—Darby & Darby

[57] ABSTRACT

A drum-type washing machine includes a horizontal shaft type drum which is rotatably supported by a supporting shaft within a frame and rotated by a motor, and a reduction mechanism transmits a rotation of a rotation shaft of the motor to a rotation shaft of the drum. The reduction mechanism includes a small pulley with gear secured to the rotation shaft of the motor, an intermediate large pulley, a V belt wound on the small pulley with gear and the intermediate large pulley, an intermediate small pulley secured to the intermediate large pulley to be rotated together with the intermediate large pulley, a large pulley secured to the rotation shaft of the drum, and a V belt wound on the intermediate small pulley and the large pulley. In the vicinity of the small pulley with gear, a claw which is normally biased toward a direction that the same is kept away from the gear is arranged. A solenoid or a torque motor engages the claw with a root of the gear against the spring when the drum is to be locked.

12 Claims, 22 Drawing Sheets

DRUM-TYPE WASHING MACHINE

BACKGROUND OF THE INVENTION

1. Field of the Invention

The present invention relates to a drum-type washing machine. More specifically, the present invention relates to a drum-type washing machine in which a rotation shaft of a motor is coupled to a rotation shaft of a drum via a reduction mechanism which includes a plurality of power transmission elements.

2. Description of the Prior Art

In such a kind of drum-type washing machine, a horizontal shaft type drum is rotatably supported within an outer tub which is supported in a frame. By coupling a rotation shaft of the drum and a rotation shaft of a motor to each other via a reduction mechanism, the drum is rotated, and the wash entered in the drum from an opening which is formed on a peripheral surface of the drum is washed or dried. In such a drum-type washing machine, in order to make the entry of the wash into the drum and the taking-out of the wash from the drum easy, it is necessary to fix the rotation of the drum in a state where the above described opening is stopped at a predetermined position.

One example of a prior art associated with such a drum lock mechanism is disclosed in Japanese Patent Laying-Open Gazette No. 63-311991 (D06F 21/04) laid-open on Dec. 20, 1988. In this prior art, a disk having a recess is secured to one end of a rotation shaft which rotatably supports a drum, and when the recess is engaged with a pin the drum is locked at a constant position.

In the above described prior art, since the drum is locked by means of the engagement of the recess of the disk which is directly fixed to the rotation shaft of the drum and the pin, an error of the recess in position directly generates deviation of a drum lock position. Therefore, in order to eliminate the deviation of the drum lock position, it is necessary to manufacture the disk, recess thereof, pin and etc. with higher precision. In addition, since the rotation shaft of the drum and the disk is directly coupled to each other, in a case where an eccentric load of the wash within the drum is large, the recess of the disk and the pin are affected by a large torque due to the eccentric load, and therefore, it is necessary to make strength of these elements large. Thus, in the prior art, a drum-type washing machine results in a high cost.

SUMMARY OF THE INVENTION

Therefore, a principal object of the present invention is to provide a drum-type washing machine in which it is possible to surely lock a drum at a predetermined position with an inexpensive structure.

A drum-type washing machine in accordance with the present invention comprises: a drum rotatably supported by a rotation shaft and having an opening for entering and taking-out the wash; a motor having a rotation shaft and for applying a rotation power to the drum; a reduction mechanism including a plurality of power transmission elements and for transmitting the rotation of the rotation shaft of the motor to the rotation shaft of the drum while a speed is reduced; and a drum lock mechanism for acting on a power transmission element of the reduction mechanism next to the rotation shaft of the motor and for locking the drum.

The wash is entered in the drum from the opening and a washing operation is started. During the washing operation, the rotation shaft of the motor is coupled to the rotation shaft of the drum through the reduction mechanism such that the drum can be rotated. If the washing operation is terminated, by utilizing an electric braking means such as a direct current brake of the motor, a state where the opening of the drum is present at a predetermined position is maintained. In such a state, the drum lock mechanism acts on the power transmission element constituting the reduction mechanism and next to the motor, for example, a pulley secured to the rotation shaft of the motor, whereby the drum can be locked.

In accordance with the present invention, since the drum lock mechanism acts on the element of the power transmission elements which are included in the reduction mechanism, which is nearest to the motor, deviation of a lock position of the power transmission element by the drum lock mechanism appears on the rotation shaft of the drum while being reduced according to a reduction ratio of the reduction mechanism. Therefore, even if the lock position of the power transmission element in the reduction mechanism is deviated to some extent, the drum can be locked at the predetermined position with no deviation. In a case where the reduction ratio is 1:6, for example, even if the lock position of the power transmission element is deviated by 6°, for example, the deviation of the lock position of the drum is 1°, and thus, no problem occurs in practical use. Therefore, it is possible to stop or lock the drum at an exact position even if the dimensional accuracy in the drum lock mechanism is not increased very, and therefore, a manufacturing or working cost of these components becomes low, and consequently, it is possible to obtain a less expensive drum-type washing machine.

Furthermore, since the power transmission element of the reduction mechanism next to the motor exists at a position that is affected by the least influence of the torque of the drum, in accordance with the present invention wherein the drum is resultingly locked by acting on the power transmission element, the torque acting on a lock portion due to an eccentric load of the wash within the drum is very small. Therefore, it is possible to contract the drum lock mechanism with simplicity and compactness as a whole, and further a less expensive drum-type washing machine is obtainable.

The objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIGS. 8 to 11 are illustrative views showing a door lock mechanism, wherein FIG. 8 is a fragmentary perspective view, FIG. 9 is a top plan view, FIG. 10 is a longitudinal cross-section view showing a state where a door is locked, and FIG. 11 is a longitudinal cross-section view showing the state where a lock of a the door is released.

FIGS. 12 to 14 are illustrative views showing a drum lock mechanism, wherein FIG. 12 is a top plan view, FIG. 13 is the side view showing the state where the lock of the drum is released, and FIG. 14 is a side view showing a state where the drum is locked.

FIGS. 17 to 21 are flowcharts showing an operation for automatically opening a cover, wherein FIG. 17 is a main routine, FIG. 18 is a constant position stopping routine, FIG. 19 is a drum lock routine, FIG. 20 is a cover opening routine, and FIG. 21 is an automatic power-off routine.

FIGS. 23 to 25 are illustrative views showing a modified example of a drum lock mechanism, wherein FIG. 23 is a top plan view, FIG. 24 is a side view showing a state where a lock of a drum is released, and FIG. 25 is the side view showing the state where the drum is locked.

DETAILED DESCRIPTION OF THE PREFERRED EMBODIMENTS

Figure 1:
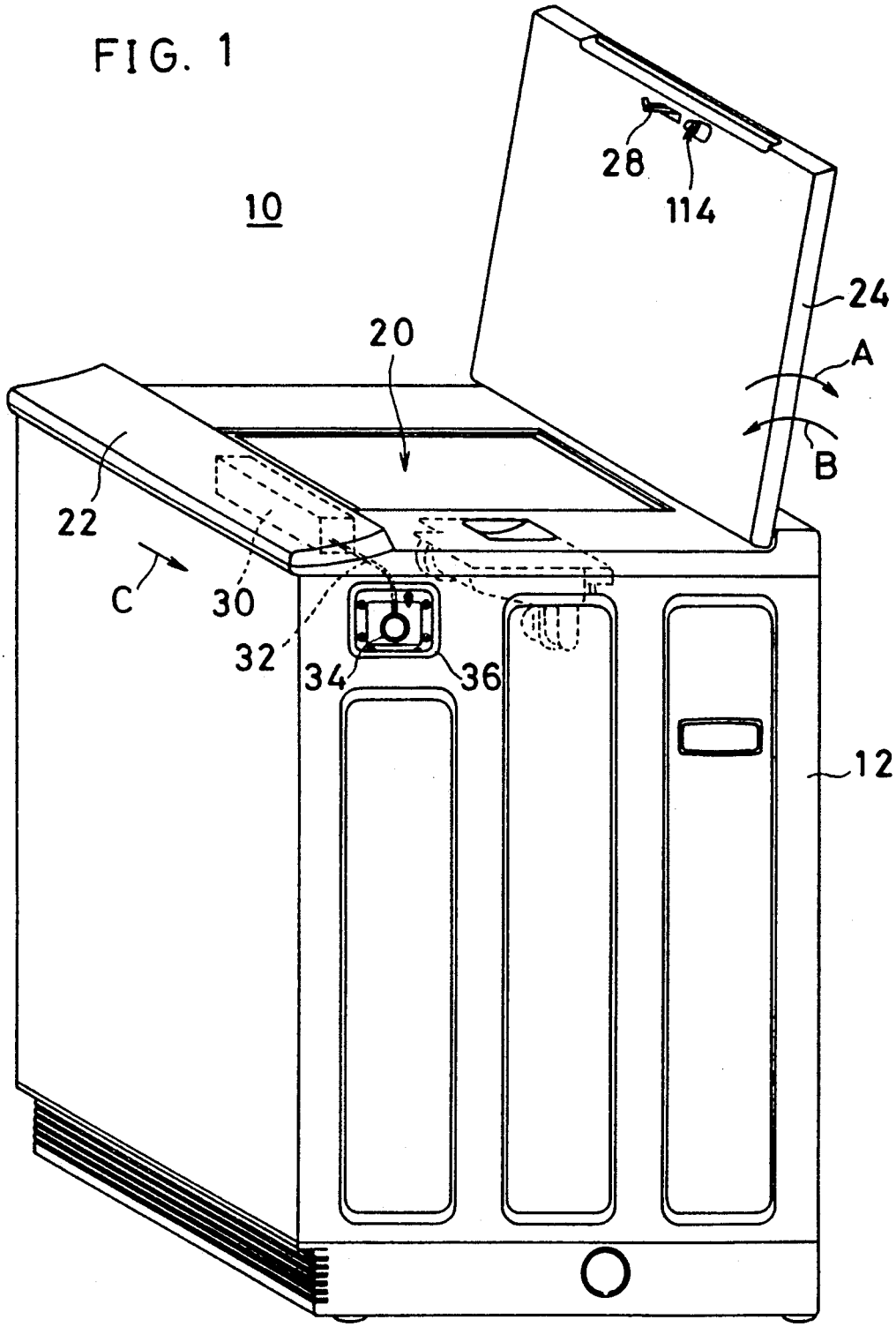
FIG. 1 is a whole perspective view showing one embodiment in accordance with the present invention.
Figure 5:
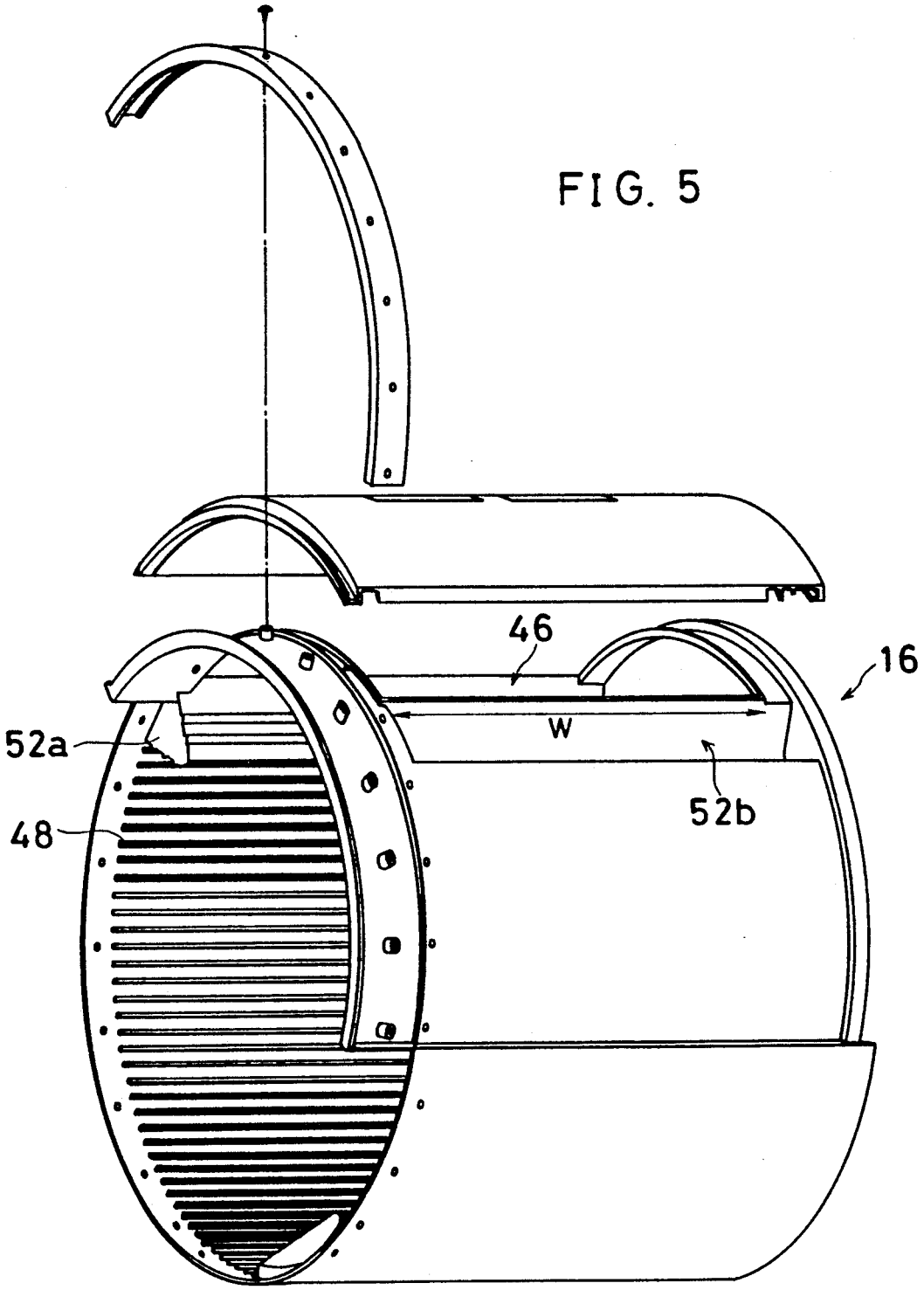
FIG. 5 is a perspective view showing one example of a drum.

A drum-type washing machine 10 shown in FIG. 1 includes a frame 12 in which an outer tub 14 (FIG. 2) is supported. A drum 16 which is manufactured by an injection molding of a synthetic resin, as shown in FIG. 5 for example is rotatably supported by a rotation shaft 18 (FIG. 2) in the outer tub 14.

An opening 20 is formed on an upper surface of the frame 12, and through the opening 20, the wash is entered in the drum 16 or the wash is taken-out from the drum 16.

In addition, an operation panel 22 is formed at this end of the upper surface of the frame 12. The operation panel 22 is provided with operation keys 22*a* (FIG. 15), display (not shown) and etc., and an operation of the drum-type washing machine 10 is controlled by operating the operation keys 22*a*.

Furthermore, a door 24 is supported on the upper surface of the frame 12 to be rotatable in a direction of an arrow mark A or B (FIG. 1) and by opening or closing the door 24, the opening 20 is opened or closed. The door 24 is normally biased in an open direction of the arrow mark A by a spring 26 (FIG. 2) incorporated in the door 24. Therefore, when a user pushes the door 24 in a direction of the arrow mark B against the force of the spring 26, a latch 28 formed at this end of a rear surface of the door 24 engages with a predetermined portion of a door lock mechanism 30 such that the door 24 can be locked.

The door lock mechanism 30 is provided between the operation panel 22 and the opening 20. A lock releasing string 32 is provided to be extended from the door lock mechanism 30, and a ring 34 formed at a tip end of the lock releasing string 32 is housed in a recess 36 formed on a side surface of the frame 12. Although not shown, the recess 36 is normally covered by a lid such that the lock releasing string 32 is hidden and it is impossible to pull the same in a normal state. Then, at a necessary timing of a stoppage of electric power or a failure, for example, the lid (not shown) is detached and the lock releasing string 32 is pulled in a direction of an arrow mark C by means of the ring 34, to produce an engaged state of the latch 28 and the door lock mechanism 30 is released and thus the door 24 is opened in the arrow mark A direction. In addition, the door lock mechanism 30 will be described later in more detail with reference to FIGS. 8 to 11.

Figure 3:
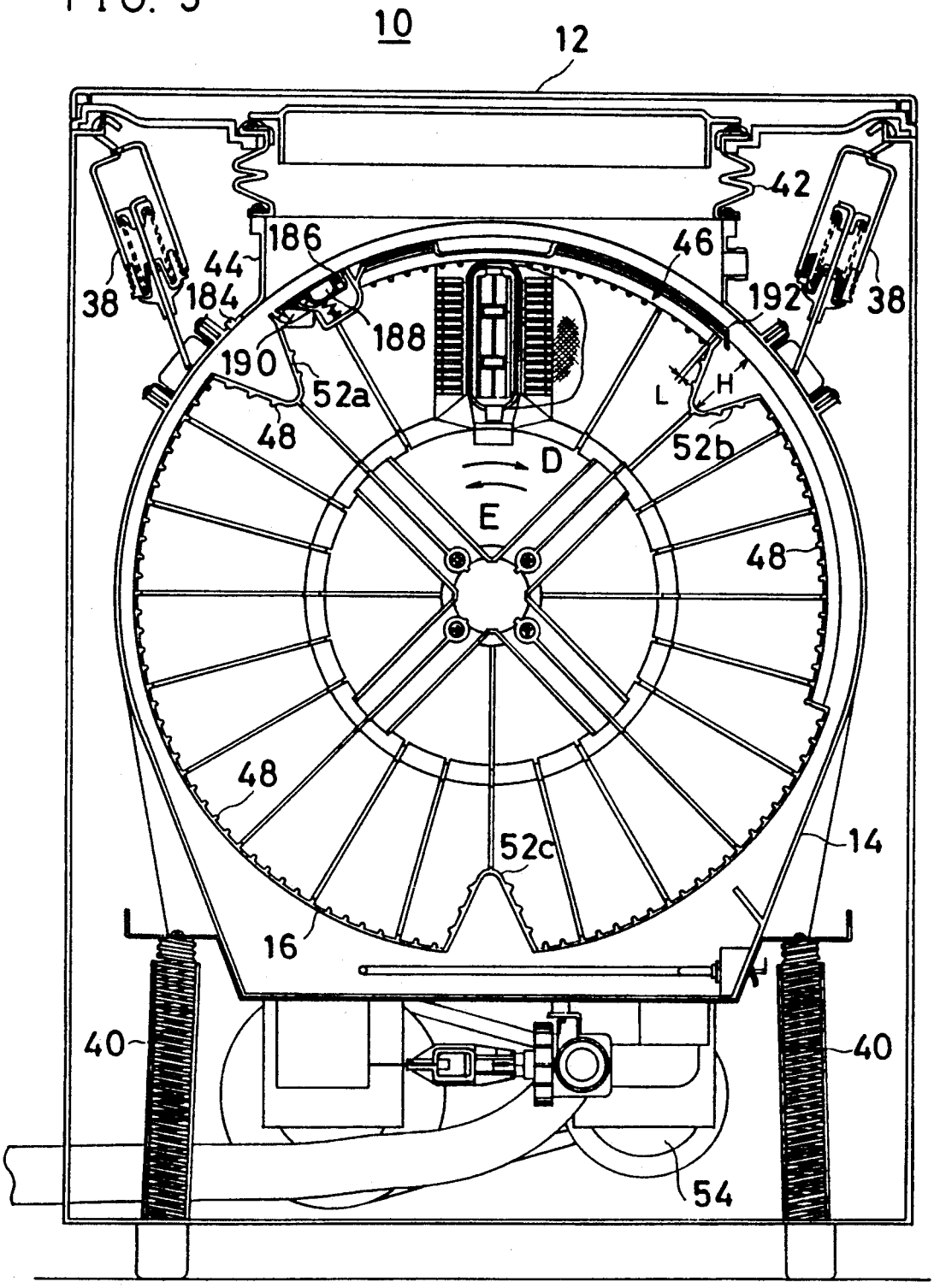
Figure 4:
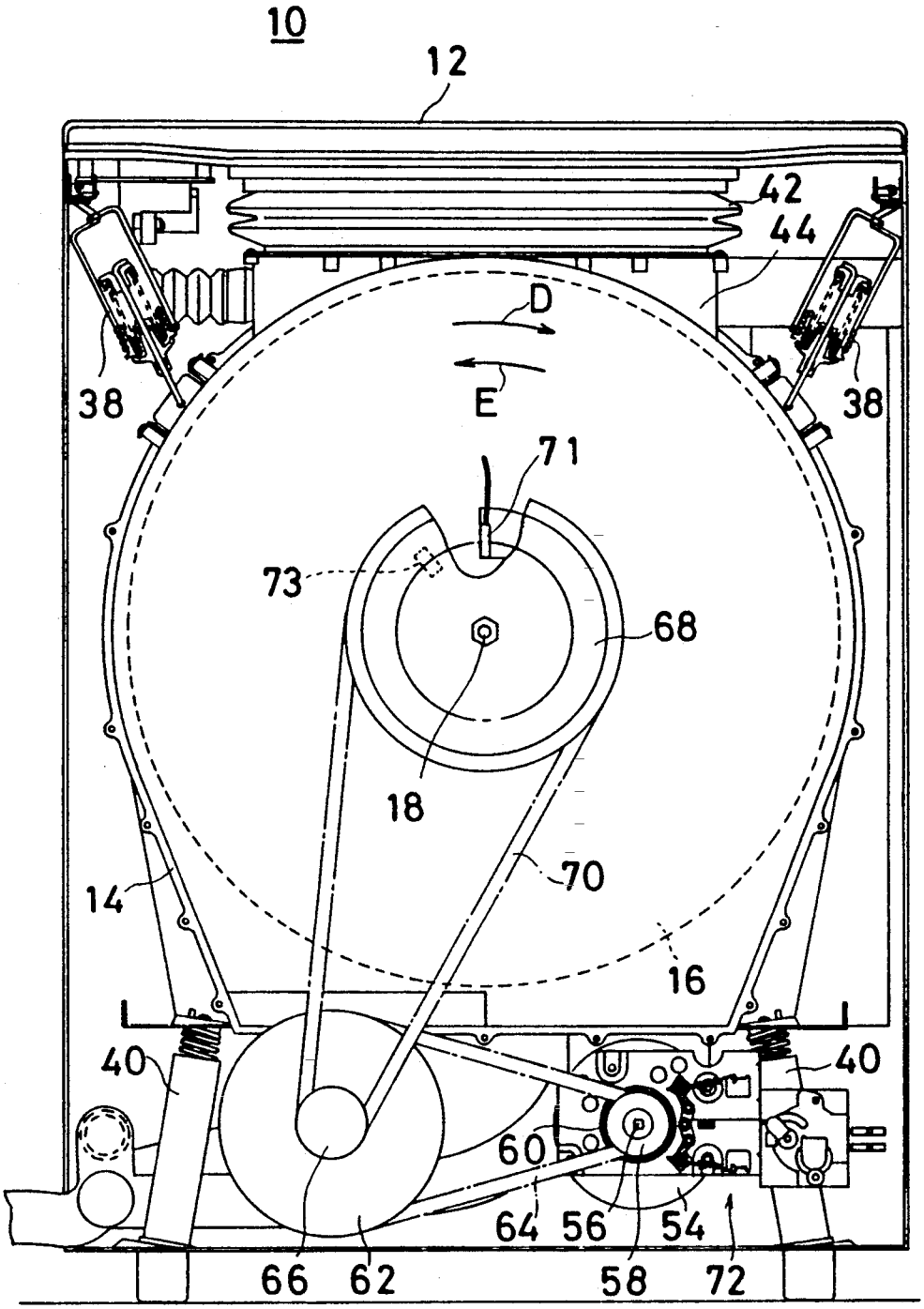

As described above, the outer tub 14 is provided within the frame 12, and the outer tub 14 is hung by springs 38 from upper four corners of the frame 12 as seen from especially FIGS. 3 and 4, and the outer tub 14 is supported on springs 40 provided at four corners of a bottom portion of the frame. Vibration of the outer tub 14 can be absorbed by these springs 38 and 40.

As shown in FIGS. 3 and 4, a rubber packing 42 in a bellows shape is fixed to the upper surface of the frame 12 to be hung from a peripheral edge which defines the opening 20 (FIG. 1) formed on the upper surface of the frame 12. An upper end of a cylindrical member 44 which functions as a guide in entering the wash into the drum 16 or taking-out the same from the drum 16 is secured to a lower end of the rubber packing 42. The cylindrical member 44 is integrally molded together with the outer tub 14 such that the outer tub 14 is fixed to a lower end thereof. As seen from FIG. 5, on a peripheral surface of the drum 16 which is rotatably supported by the rotation shaft 18 (FIG. 2) in the outer tub 14, an opening 46 through which the wash is entered in the drum 16 or taken-out therefrom is formed, and the drum 16 is stopped such that the opening 46 corresponds in position to an opening at the lower end of the cylindrical member 44, and the drum 16 can be locked in that state.

A number of ribs 48 extending in a direction of a width of the drum 16 are formed on an inner peripheral surface of the drum 16 with substantially the same intervals. A number of throughholes 50 are formed between a portion of ribs 48 to be along the ribs. On the inner peripheral surface of the drum 16, similarly, baffles 52 each having a triangle shape in cross-section are integrally formed. In this embodiment shown, two baffles 52*a* and 52*b* are formed closely to a peripheral edge defining the opening 46 of the drum 64 to be along the same, whereby a stress acting on the drum 16 is made be small and deformation of the drum in the vicinity of the opening 46 is prevented as described later. In addition, the remaining baffle 52*c* may be omitted; however, in this embodiment shown, the same is formed at a position opposite to that of the baffles 52*a* and 52*b* because of an equilibrium of the static balance therebetween. The wash in the drum 16 is lifted and dropped by these baffles 52*a*–52*c* in accordance with the rotation of the drum 16 in a direction of an arrow mark D or E (FIGS. 3 and 4).

Figure 2:
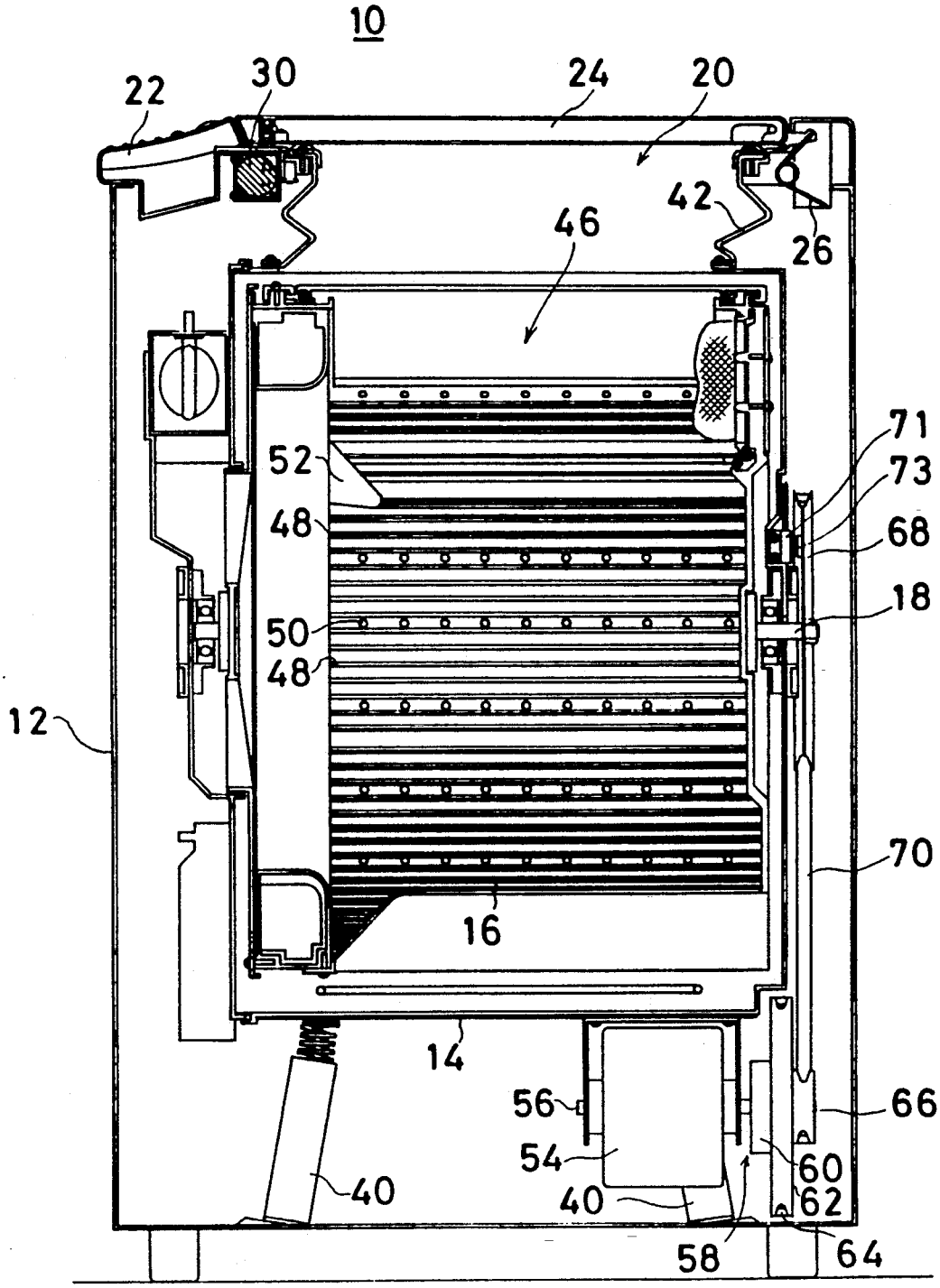
FIGS. 2 to 4 are illustrative views showing structure inside of a frame of FIG. 1 embodiment.

Below the outer tub 14, a motor 54 for rotating the drum 16 in a washing operation, dehydrating operation, drying operation and etc., and as seen from FIGS. 2 and 4, a small pulley with gear 58 is secured to a rotation shaft 56 of the motor 54. A gear 60 on a peripheral surface of which teeth are formed with a constant interval (for example, at every 6°) is integrally formed on the small pulley with gear 58. Then, a V belt 64 is wound on a V groove of the small pulley with gear 58 and a V groove of an intermediate large pulley 62. An intermediate small pulley 66 is secured to the intermediate large pulley 62 to be rotated with the pulley 62, and a V belt 70 is wound on the intermediate small pulley 66 and a large pulley 68 which is fixed to the rotation shaft 18 of the drum 16. A reduction and power transmission mechanism from the motor 54 to the drum 16 is constituted by these power transmission elements, that is, the pulleys 58, 62, 66 and 68 and the V belts 64 and 70. In this embodiment shown, the rotation speed of the rotation shaft 56 of the motor 54 is transmitted to the rotation shaft 18 of the drum 16 through the reduction mechanism while being reduced by approximately 1/6.

There is provided with a drum lock mechanism 72 (FIG. 4) for acting on an element next to the motor 54 out of the power transmission elements constituting the reduction mechanism, that is, the small pulley with gear 58 in this embodiment shown for fixing the drum at a predetermined position.

In addition, for such stopping and locking of the drum 16 at a constant position, a reed switch 71 is fixed at approximately center of the opening 46 in a peripheral direction of the drum 16, and a magnet 73 which acts on the reed switch 71 is bured on an inner side surface of the large pulley 68 on the drum. Then, when the reed switch 71 is turned-on (or turned-off) by the magnet 73, an electrical braking force is applied to the motor 54 and the drum 16 is stopped in a state where the opening 46 is corresponding in position to the opening 20 (FIG. 1), and the drum 16 is locked by the drum lock mechanism 72.

Now, with reference to FIGS. 5 to 7, the drum 16 and the baffles 52*a* and 52*b* provided thereon will be described. In this embodiment shown, the baffles 52*a* and 52*b* are, as described above, formed to be closed in the peripheral edge defining the opening 46 and to be along the same. More specifically, in assuming that height of the baffles 52*a* and 52*b* shown in FIG. 3 are H and a distance from a base of the baffle 52*a* or 52*b* to the peripheral edge of the opening 46 is L, the height H and the distance L are so set as to satisfy $H \geqq L$. In this embodiment shown, it is set as $L \approx 0$. Thus, by forming the baffles 52*a* and 52*b* to be close and along with the peripheral edge of the opening 46, in entering the wash in the drum 16 or taking-out the same from the drum, it is possible to prevent the wash from being caught by the peripheral edge of the opening 46. At the same time, it is possible to compensate lowering of a mechanical strength of the drum 16 due to formation of the opening 46.

Figure 6:
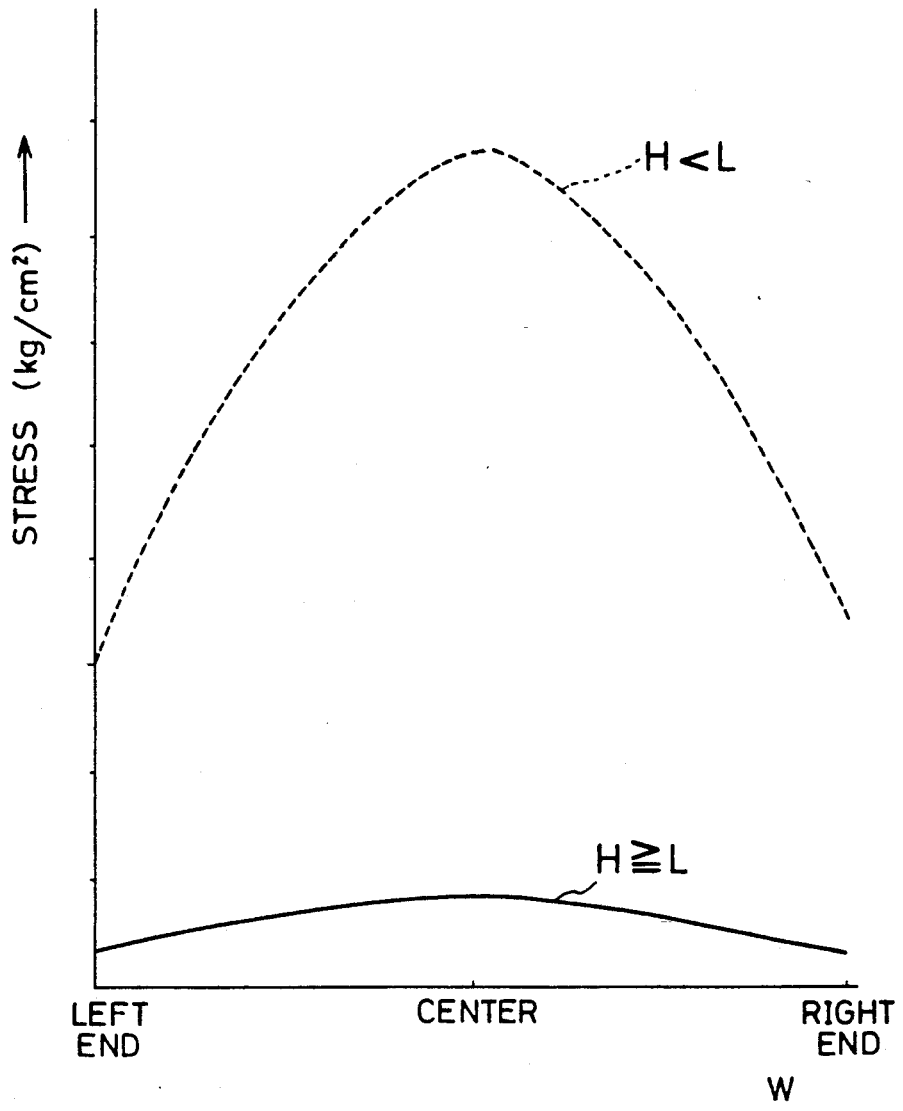
FIG. 6 is a graph showing a stress distribution in a direction of the width of the drum shown in FIG. 5.
Figure 7:
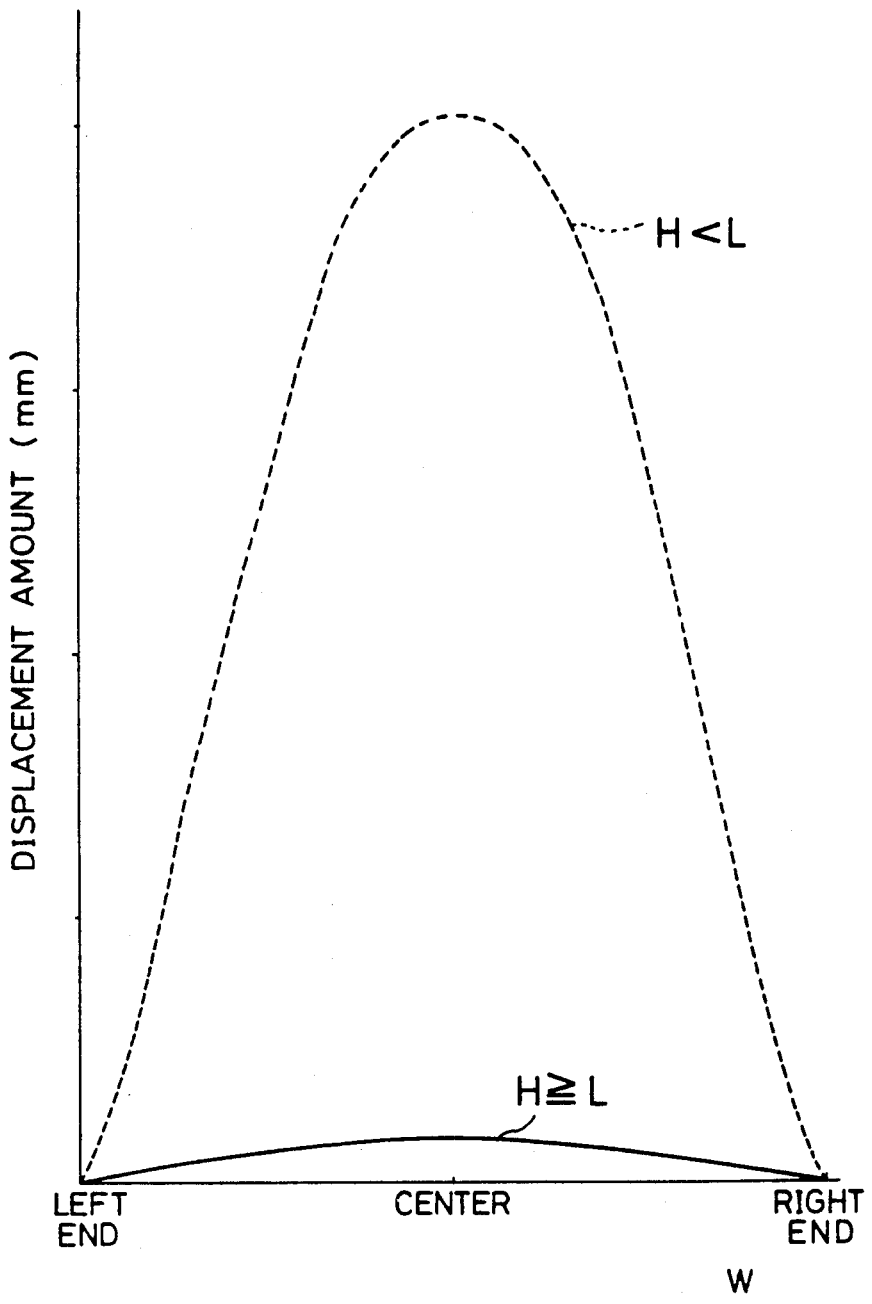
FIG. 7 is a graph showing a displacement amount in an opening of the drum shown in FIG. 5.
Figure 8:
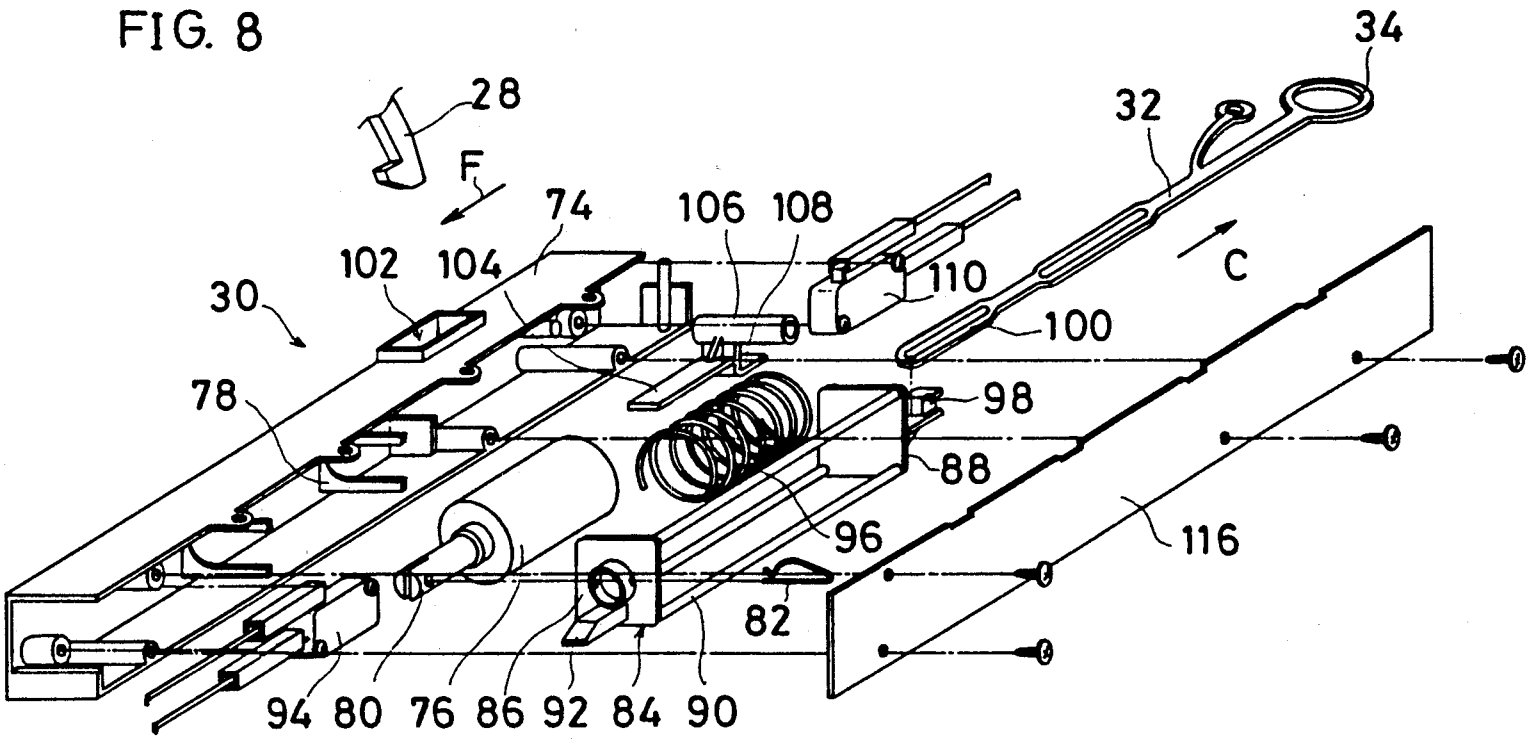
Figure 9:
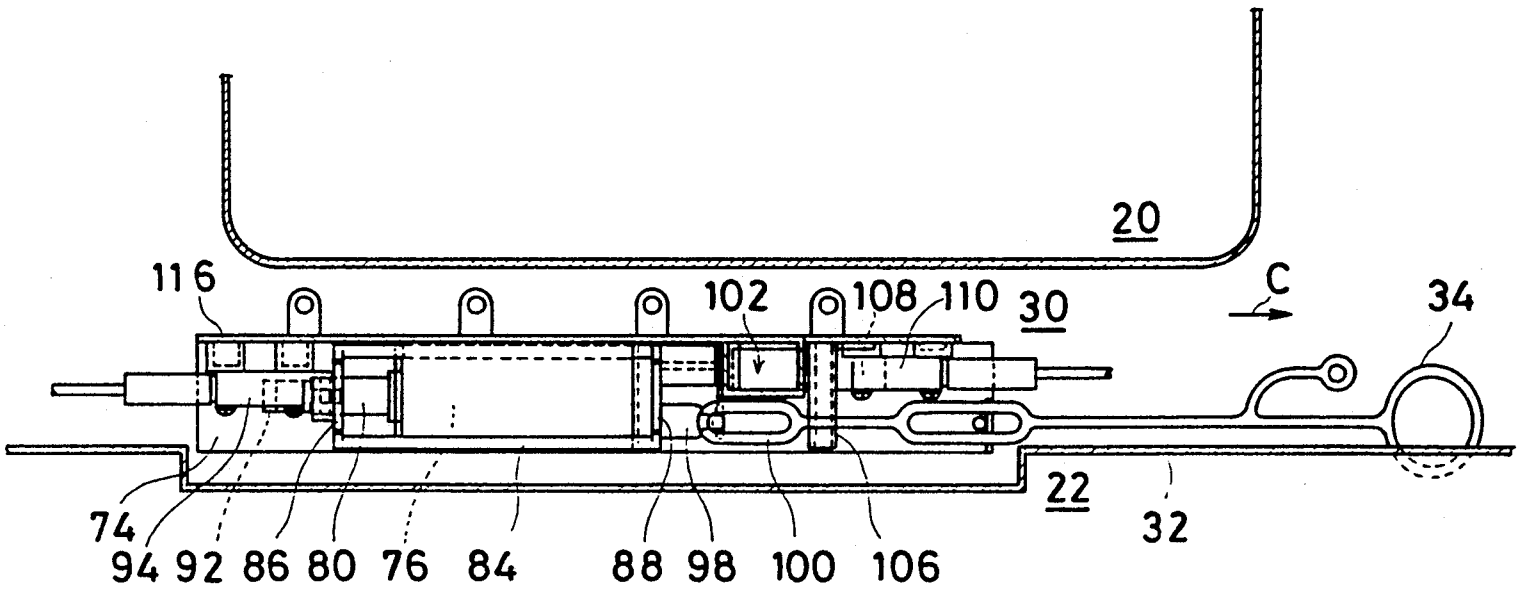

FIG. 6 is a graph showing a stress distribution at respective positions in a direction of the width W shown in FIG. 5, and FIG. 7 is a graph showing a displacement amount at the respective positions in the direction of the width W. As seen from FIG. 6 and FIG. 7, in a case where the height H and the distance L are set so as to satisfy the relationship of $H \geqq L$, in comparison with a case of $H < L$, not only stress concentration can be largely reduced but also the displacement amount becomes very small.

In accordance with experiments performed by the inventors et al. by using a drum of a given size, a maximum stress of a case $H < L$ shown by a dotted line in FIG. 6 was 783 kg/cm$^2$, in contrast, a maximum stress in a case of $H \geqq L$ shown by a solid line was 83 kg/cm$^2$, and thus, it was possible to reduce a maximum stress by approximately 90%. In addition, a maximum displacement amount in a case of $H < L$ shown by a dotted line in FIG. 7 was 40.7 mm, in contrast, a maximum displacement amount in a case of $H \geqq L$ shown by a solid line was 1.4 mm, and thus, it was possible to reduce a maximum displacement amount by approximately 96%. Therefore, as done in this embodiment shown, by forming the baffles 52*a* and 52*b* closely to the peripheral edge of the opening 46 of the drum 16, the mechanical strength of the drum 16 can be increased.

Next, with reference to FIGS. 8 to 11, the door lock mechanism 30 will be described in detail. The door lock mechanism 30 includes a casing 74 having a rectangular shape in cross-section, and an electromagnetic solenoid 76 having a cylindrical shape is housed in the casing 74. To this end, a solenoid holding portion 78 having an inner edge of a circle shape is formed on a side surface of the casing 74. To a plunger 80 of the electromagnetic solenoid 76, a movable block 84 is connected by a pin 82. The movable block 84 includes two plates 86 and 88 parallel with each other and three connection rods 90 connecting the same, and the front plate 86 is fixed to the plunger 80 by the pin 82. Then, a projection 92 having a wedge shape and projecting toward a front is secured to a lower portion of the front plate 86 so that the projection 92 acts on an actuator of a microswitch 94 attached in a front of the electromagnetic solenoid 76. Therefore, the microswitch 94 outputs an on or off signal according to a state of the electromagnetic solenoid 76, i.e. a position of the movable block 84.

The electromagnetic solenoid 76 is accommodated in a space of the movable block 84 surrounded by the connection rods 90, and a spring 96 is inserted between the back plate 88 of the movable block 84 and the electromagnetic solenoid 76. Normally, the spring 96 pulls the electromagnetic solenoid 76 and the back plate 88 in a direction that the both approach to each other. However, if the electromagnetic solenoid 76 is activated, the plunger 80 of the electromagnetic solenoid 76 is pulled-in, and therefore, the movable block 84 is moved toward a rear direction by the electromagnetic solenoid 76 against a tractive force of the spring 96.

An engagement portion 98 is formed on the rear plate 88, and the engagement portion 98 is engaged with a longitudinal circle portion 100 of the tip end of the above described lock releasing string 32. On the upper surface of the casing 74, a latch hole 102 to which the latch 28 formed on the lower surface of the door 24 is inserted when the door 24 is closed is formed. In addition, as seen from FIG. 10 and FIG. 11, the latch 28 is rotatably attached by a shaft 28*a*, and the same is normally biased in a direction of an arrow mark F by a latch spring 28*b*. Therefore, when the door 24 is pushed down, the latch 28 can engage with an engagement portion 102*a* which is formed on an inner peripheral edge of the latch hole 102 by means of a spring force of the spring 28*b*.

Furthermore, below the latch hole 102, an action piece 104 which is pushed by the latch 28 when the latch is inserted is rotatably attached by a shaft 106, and a further action piece 108 is fixed to the shaft 106, the action piece 108 acts on an actuator of a microswitch 110 which is attached in the vicinity thereof. Therefore, an on or off signal is outputted from the microswitch 110 in accordance with whether or not the latch 28 is inserted.

Figure 10:
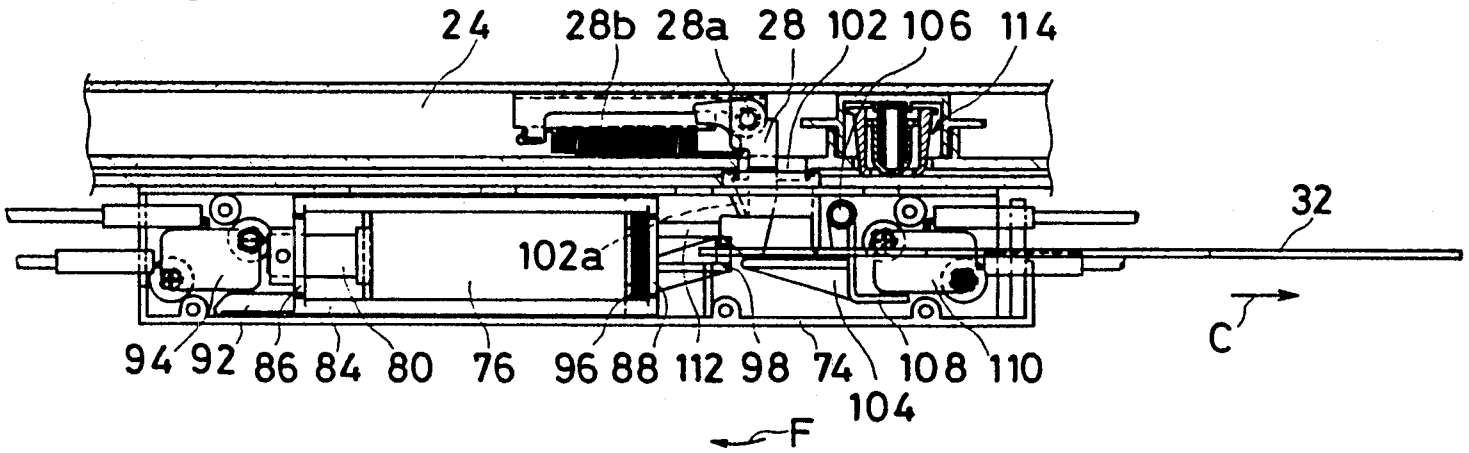

When the electromagnetic solenoid 76 is turned-off in response to a control signal from a control means such as a microcomputer or the like, as shown in FIG. 10, the plunger 80 is projected, and therefore, the movable block 84 is moved toward in a front direction, that is, a reverse direction to a direction of the arrow mark C. Therefore, the microswitch 94 is turned-on by the projection 92 at the front of the movable block 84 and the action piece 104 is pushed down by the latch 28 engaged with the engagement portion 102*a* of the latch hole 102, and therefore, the microswitching 110 is turned-on by the action piece 108.

Figure 11:
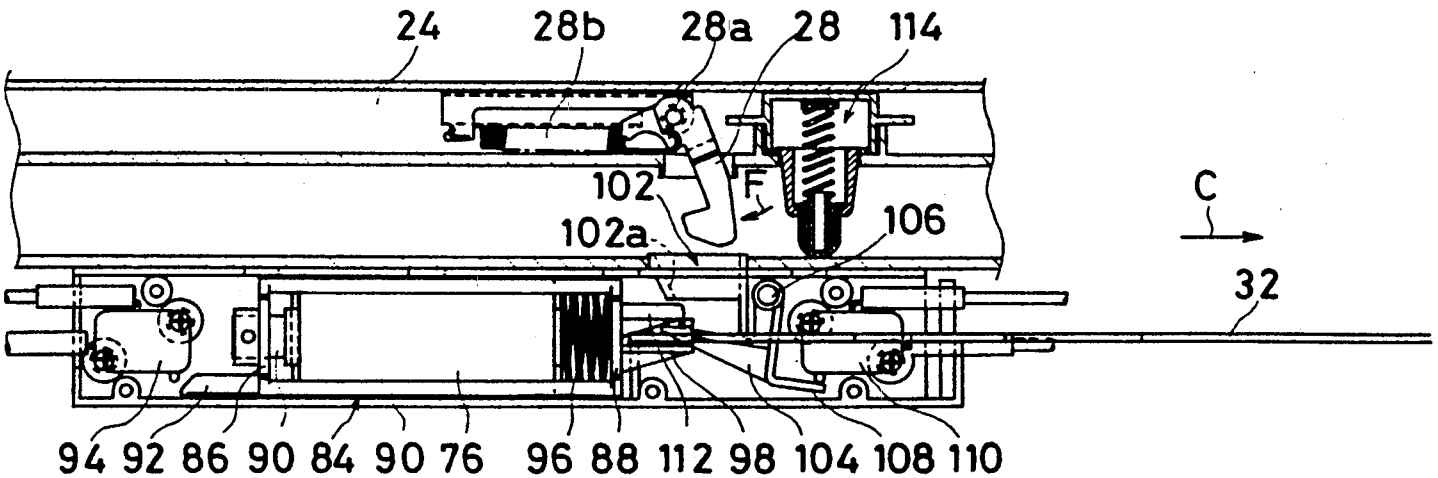

When the electromagnetic solenoid 76 is turned-on, as shown in FIG. 11, the plunger 90 is retracted, and therefore, the movable block 84 is moved toward in a rear direction against the spring force of the spring 96. Therefore, the latch 28 is pushed toward a direction reverse to a direction of the arrow mark F by a projection 112 which is formed on the rear plate 88. Therefore, the latch 28 is disengaged from the engagement portion 102*a*. At the same time, the door 24 is pushed up by the spring 26 (FIG. 2) and a push spring 114, and therefore, the door 24 is opened.

In addition, if the lock releasing string 32 is pulled toward a direction of the arrow mark C in a state where the electromagnetic solenoid 76 is turned-off, the movable block 84 is moved toward in a rear direction, that is, a direction of the arrow mark C, and the latch 28 is pushed toward a direction reverse to a direction of the arrow mark F by the projection 112 which is projectingly formed on the rear plate 88, and therefore, the engagement between the latch 28 and the engagement portion 102*a* of the latch hole 102 is released. Therefore, the door 24 is forcedly opened.

In addition, the casing 74 is closed by a lid 116. Then, as seen from FIG. 9, the casing 74, i.e. the door lock mechanism 30 is arranged between the operation panel 22 and the opening 20 (FIG. 1). Therefore, no specific space for the lock mechanism 30 is required, and therefore, it is possible to save a space in a direction of the height, especially. In addition, if such structure is adopted, there is a subsidiary advantage that the lack of the strength of the opening 20 can be reinforced by the casing 74 of the lock mechanism 30.

Figure 12:
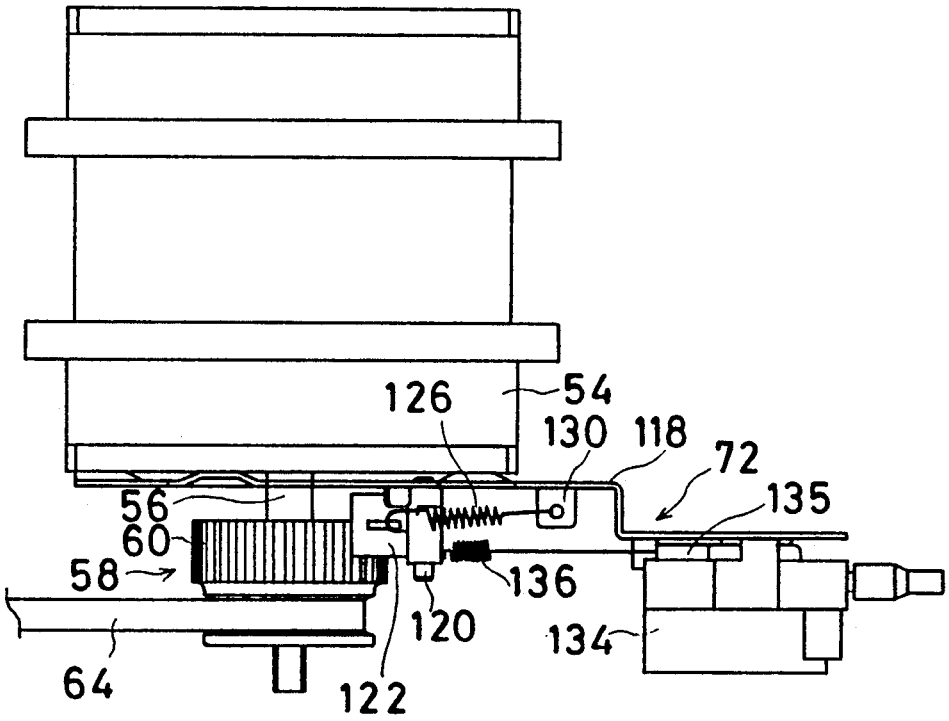
Figure 13:
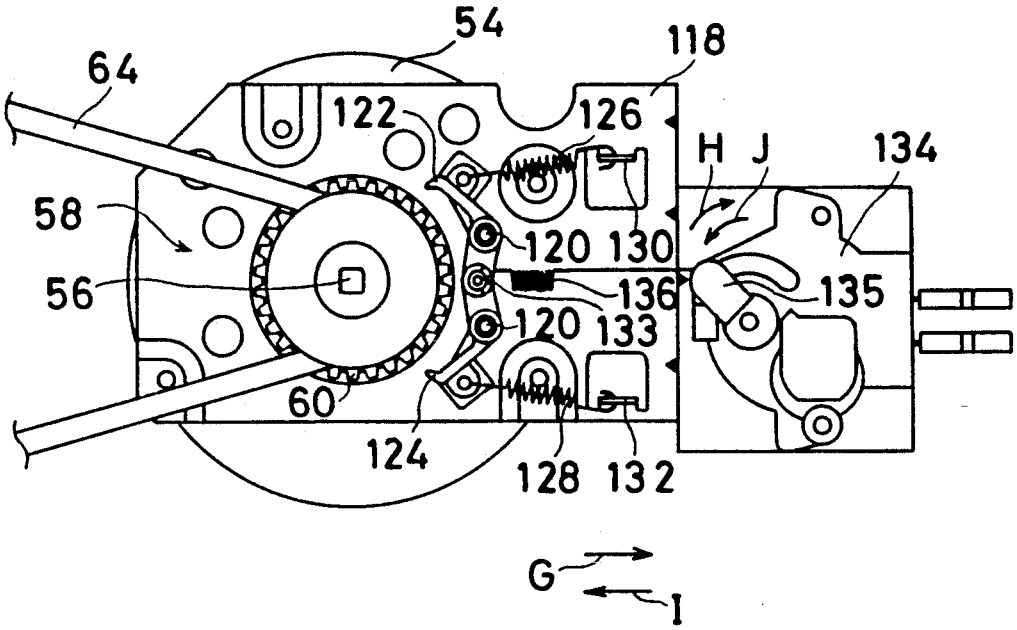
Figure 14:
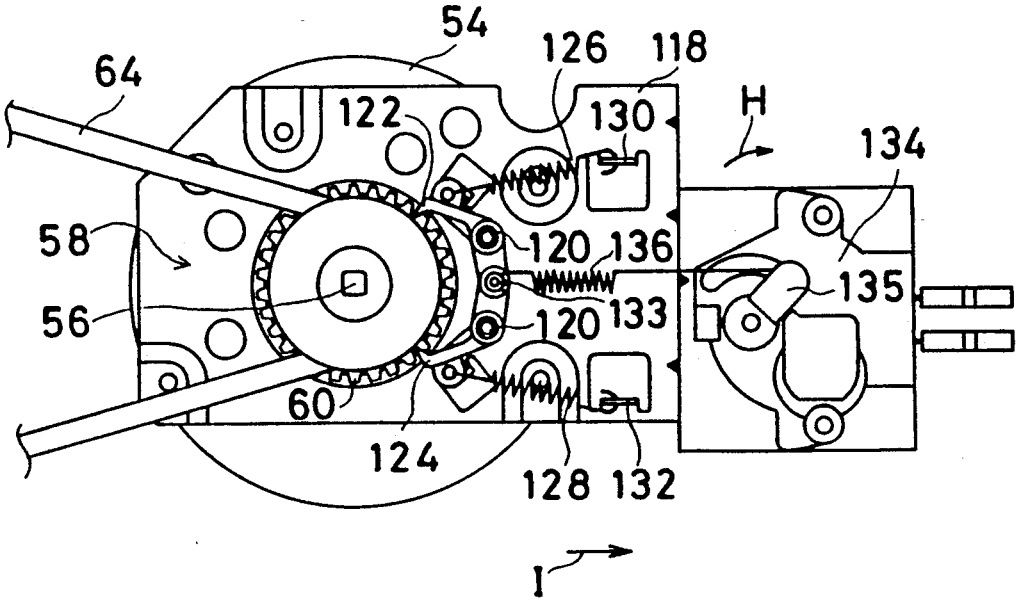

With reference to FIGS. 12 to 14, the drum lock mechanism 74 provided in the vicinity of the motor 54 includes an angle 118 fixedly attached to the frame 12, and two claws 122 and 124 each having approximately V-letter shape are rotatably supported on the angle 118 by a shaft 120. The claws 122 and 124 are positioned to be engaged with the gear 60 of the small pulley with gear 58 at tip ends thereof. Respective one ends of coil springs 126 and 128 are hooked to the respective claws 122 and 124, and respective other ends of the coil springs 126 and 128 are hooked to engagement portions 130 and 132 which are formed on the angle 118. Therefore, the claws 122 and 124 are normally pulled toward a direction of an arrow mark G by the coil springs 126 and 128. In addition, respective other grooves of the claws 122 and 124 are connected to each other by a shaft 133, and both ends of a further coil spring 136 are respectively hooked to the shaft 133 and a shaft 135 of a torque motor 134. The coil spring 136 pulls the shaft 133 toward a direction of an arrow mark I when the torque motor 134 is turned-on and the shaft 135 is displaced toward a direction of an arrow mark H. In reverse, when the torque motor 134 is turned-off, the shaft 135 of the torque motor 134 is displaced toward a direction of an arrow mark J, and therefore, the coil spring 136 returns to an original state thereof.

Therefore, as shown in FIG. 14, when the torque motor 134 is turned-on, the shaft 135 is rotated in a direction of the arrow mark H and the shaft 133 is pulled toward a direction of the arrow mark I. Therefore, the claws 122 and 124 connected to each other by the shaft 133 are rotated in a direction that the tip ends thereof are closed to each other. Accordingly, the respective tip ends of the claws 122 and 124 are fit into a portion between the teeth (root) portions of the gear 60 of the small pulley with gear 58. Therefore, the small pulley with gear 58 is fixed at that position, and the V belt 64 connected to the small pulley with gear 58 and thus the drum 16 (FIGS. 3 and 4) is fixed at that position.

In addition, as shown in FIG. 13, when the torque motor 134 is turned-off, the shaft 135 returns to a direction of the arrow mark J and the coil spring 136 is extended. Therefore, the claws 122 and 124 are pulled by the springs 126 and 128 toward a direction of the arrow mark G. Accordingly, the engagement of the claws 122 and 124 and the gear 60 of the small pulley with gear 58 is released as shown in FIG. 13. Therefore, the small pulley with gear 58 and thus the drum 16 can be rotated by the motor 54.

In this embodiment shown, as described above, the drum 16 is resultingly locked at a predetermined position by inhibiting the rotation of the power transmission element next to the motor 54 out of the power transmission elements constituting the reduction mechanism, that is, the small pulley 58. Therefore, the deviation of the locked position of the small pulley 58 is reduced according to the reduction ratio of the reduction mechanism and transmitted to the rotation shaft 18 of the drum 16, and therefore, the locked position of the drum 16 is hardly deviated even if the locked position of the small pulley 58 is deviated to some extent. When the reduction ratio is 1/6, for example, even if the locked position of the small pulley 58 is deviated by one root portion (6°), the deviation of the locked position of the drum 16 is 1°. Therefore, a higher working accuracy of the gear 60 and other components is not required, and therefore, it is possible to reduce a manufacturing cost.

In addition, in the embodiment shown in FIGS. 12–14, the gear 60 is locked by the two claws 122 and 124, and therefore, it is possible to surely lock the drum 16 in either a right direction or a left direction.

Furthermore, since the shaft 133 is pulled by the coil spring 136 when the roots of the gear 60 are engaged by the claws 122 and 124, even if the claws 122 and 124 ride on the teeth of the gear 60, the claws 122 and 124 surely engage the roots as far as the motor 54 is slightly rotated in a left or right direction. Therefore, it is possible to securely lock the drum. In addition, the claws 122 and 124 are always pulled by the springs 126 and 128 at a position where the same do not touch the gear 60, and therefore, no can occur that the drum 16 is locked while no drum lock signal is applied occurs.

Figure 15:
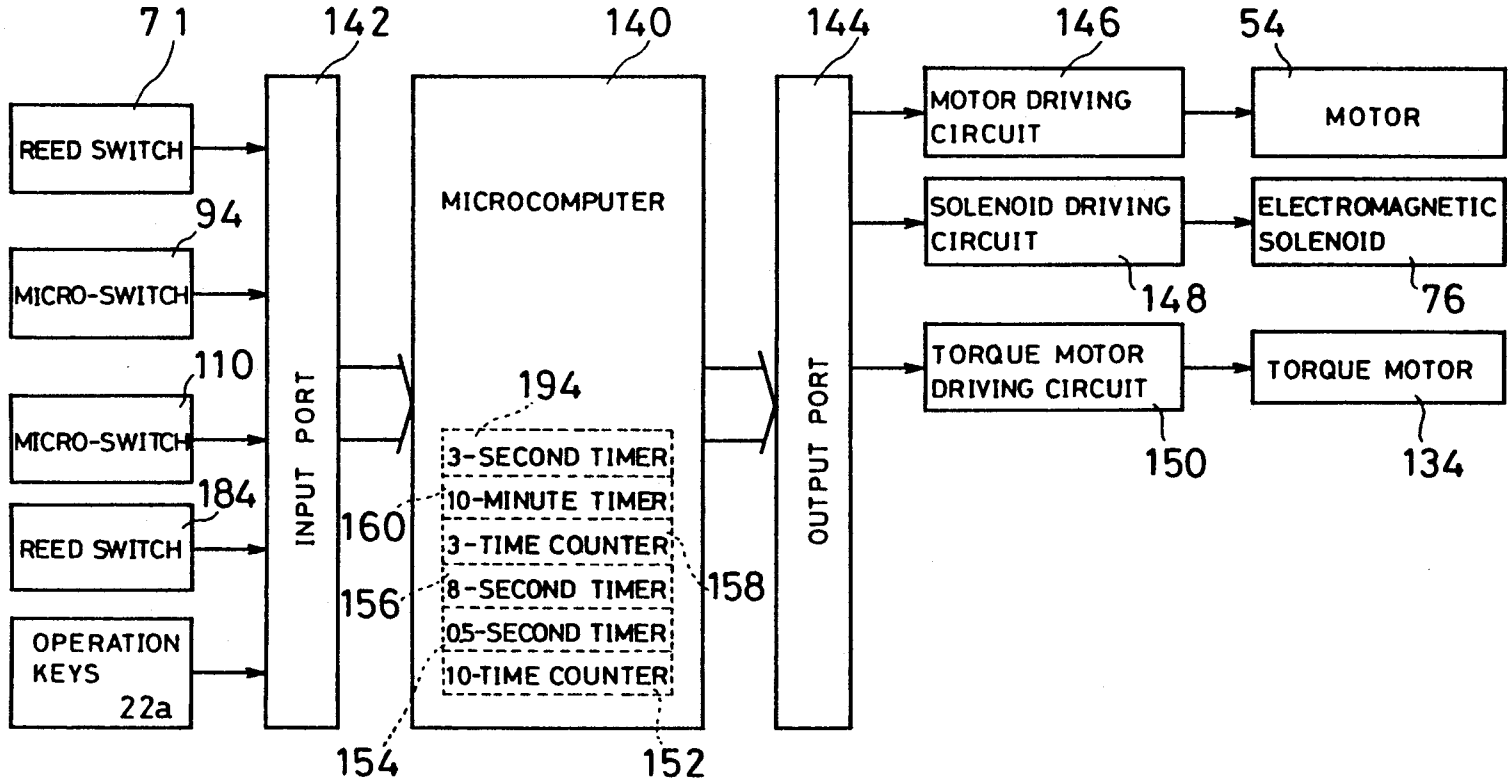
FIG. 15 is a block diagram showing a control circuit of the embodiment.

As shown in FIG. 15, there is provided a microcomputer 140, and the drum-type washing machine 100 is basically controlled by the microcomputer 140. The reed switch 71 (FIG. 4), the microswitch 94 and the microswitch 110 (FIG. 8) are connected to an input port 142 of the microcomputer 140. Therefore, on or off signals of the reed switch 71, microswitch 94 and microswitch 110 are inputted to the microcomputer 140 through the input port 142. The operation keys 22*a* provided in the operation panel 22 (FIG. 1) are also connected to the input port 142 so that key input signals can be applied to the microcomputer 140.

In addition, a motor driving circuit 146 is connected to the microcomputer 140 via an output port 144. The motor driving circuit 146 turns the motor 54 on or off or applies an electrical braking force to the motor 54. A solenoid driving circuit 148 is further connected to the output port 144, and the electromagnetic solenoid 76 (FIG. 8) is turned-on or off by the solenoid driving circuit 148. Then, to the output port 144, a torque motor driving circuit 150 for turning the torque motor 134 (FIG. 12) on or off is connected.

In addition, as well known, the microcomputer 140 includes a central processing unit (CPU), RAM, ROM and etc., and necessary counter areas, timer areas, flag areas and so on are assigned in the RAM. In this embodiment shown, there are 10-time counter 152, 0.5-second timer 154, 8-second timer 156, 3-time counter 158, 10-minute timer 160 and etc. which are used in a later description of operation.

Figure 16:
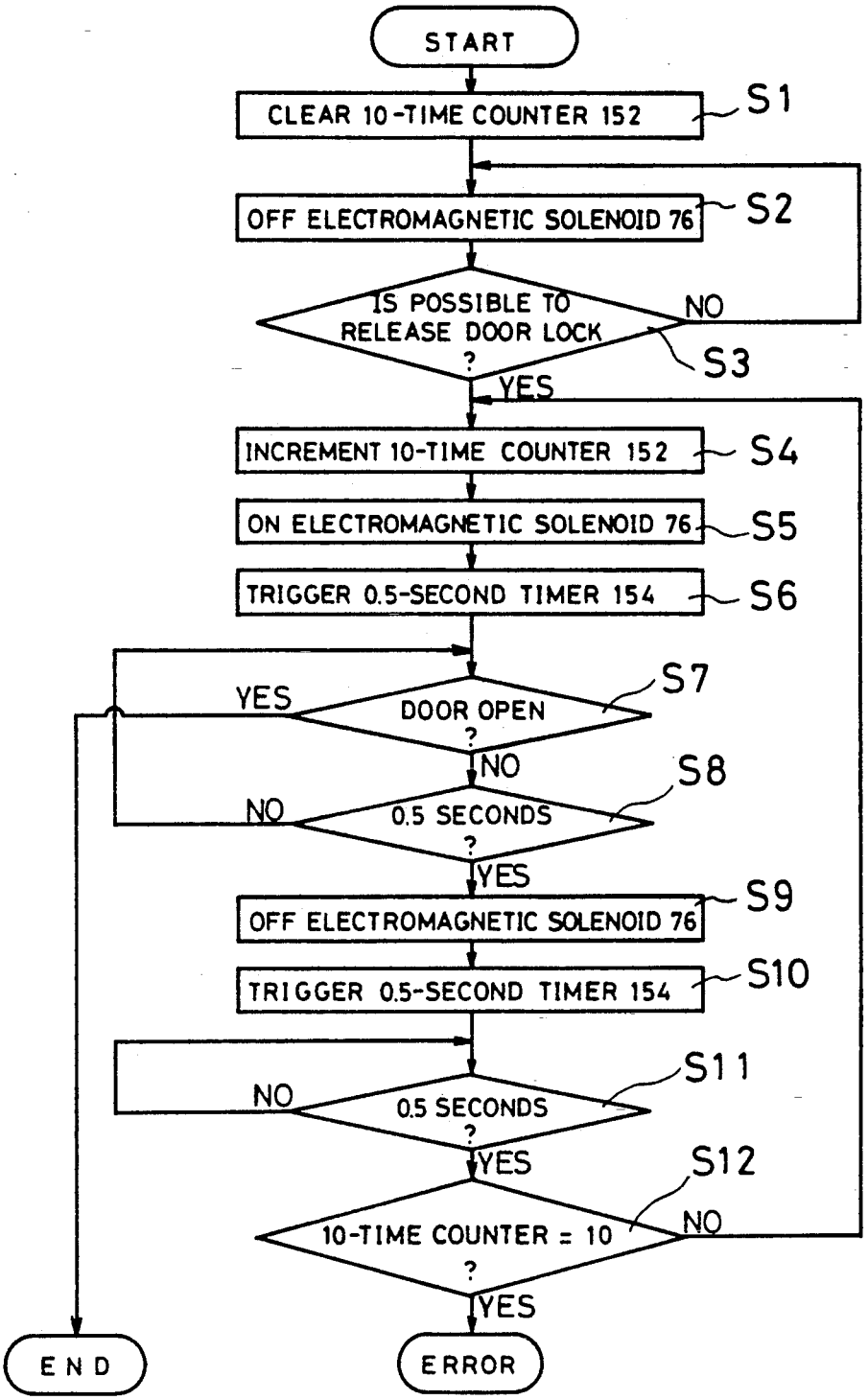
FIG. 16 is a flowchart showing an operation for releasing a lock of a cover.

With reference to FIG. 16, at first, a description of an operation for releasing a lock of the door 24 will be made. In the first step S1 of FIG. 16, the 10-time counter 152 is cleared by the microcomputer 140. Next, in the step S2, the microcomputer 140 applies a signal to the solenoid driving circuit 148 through the output port 144 to turn the electromagnetic solenoid 76 (FIG. 8) on. Therefore, the plunger 80 is pulled-in against an attractive force of the spring 96, and the movable block 84 is moved toward a rear direction as shown in FIG. 11. In this state, the microcomputer 140 waits until a condition where a lock of the door may be released is detected in the step S3.

The condition where the lock of the door may be released is detected in the step S3, in the next step S4, the microcomputer 140 increments the 10-time counter 152. Then, in the next step S5, the microcomputer 140 outputs a signal from the output port 144 to the solenoid driving circuit 148 to turn the electromagnetic solenoid 76 off. Accordingly, the plunger 80 of the electromagnetic solenoid 76 is pushed-out by the spring 96 as shown in FIG. 10, and the movable block 84 is moved toward a front direction. Then, in the step S6, the microcomputer 140 triggers the 0.5-second timer 154.

In the step S7, the microcomputer 140 determines on the basis of signals which are applied to the microswitches 94 and 110 through the input port 142 whether or not the door 24 is opened. That is, when the electromagnetic solenoid 76 is turned-off, the movable block 84 is moved toward a front direction, and therefore, as shown in FIG. 10, the projection 92 pushes the actuator of the microswitch 94 and the action piece 108 pushes the actuator of the microswitch 110. Therefore, both the microswitches 94 and 110 are turned-on. Accordingly, it is possible to determine whether or not the door 24 is opened by detecting whether or not the signals of the microswitches 94 and 110 are on signals (high levels).

If it is not detected that the door 24 is opened until time-up of the 0.5-second timer 154 is detected in the step S8, in the next step S9, the microcomputer 140 turns the electromagnetic solenoid 76 on as done in the step S2. In addition, the microcomputer 140 triggers the 0.5-second timer 154 and, when the microcomputer detects the time-up of the 0.5-second timer 154 in the step S11, the microcomputer 140 determines whether or not a counted value of the 10-time counter 152 is "10" in the next step S12. If the counted value of the 10-time counter 152 is not "10", the process returns to the previous step S4, but the counted value of the 10-time counter 152 is "10", an error is determined, and a further error routine is executed so that an abnormal state can be notified by flashing an LED, ringing a buzzer or the like.

Next, a description of an operation for opening the door 24 by means of a key operation will be made with reference to FIGS. 17 to 21. If a door opening key (not shown) which is included in the operation keys *22a* (FIG. 15) is depressed in the step S10 of FIG. 17, the process jumps to the first step S21 of a constant position stopping routine shown in FIG. 18. More specifically, in a case where the door 24 is automatically opened, the drum 16 is necessarily stopped at a constant position and the door 24 is to be opened after the drum 16 is locked.

Then, in the step S21, the microcomputer 140 commands a low speed rotation to the motor driving circuit 146 via the output port 144. Responsively, in the step S21, the motor driving circuit 146 (FIG. 15) drives the motor 54 at a low speed. In the case where the motor 54 is an inverter motor, for such a low speed rotation, the motor driving circuit 146 applies the driving signals of 2 Hz to respective phases of the motor 54. Therefore, the motor 54 is rotated at a low speed, and the rotation of the motor 54 is transferred to the rotation shaft 18 of the drum 16 via the reduction mechanism so that the drum 16 is rotated at 30 rpm, for example. In response to the rotation of the drum 16 in a direction of the arrow mark D or E (FIG. 4), the magnet 73 buried in the large pulley 68 is rotated and shortly reaches a position of the reed switch 71. Then, an on-signal is inputted to the microcomputer 140 from the reed switch 71 through the input port 142. Therefore, "YES" is determined in the step S22. That is, a low speed rotation of the motor 54 is performed until the drum 16 reaches a predetermined position, that is, position where the opening 46 corresponds in position to the opening 20 in the step S22.

If "YES" is determined in the step S22, in the step S23, the microcomputer 140 outputs a braking signal to the motor driving circuit 146 through the output port 144. Therefore, the motor driving circuit 146 applies a direct current braking signal to the motor 54. In the case where the motor 54 is an inverter motor, pulse signals of 15 kHz are simultaneously applied to two phases. Thus, a direct current braking force is applied to the motor 54. Then, the 8-second timer 158 is triggered in the step S24 and the process returns to the routine of FIG. 17.

Figure 17:
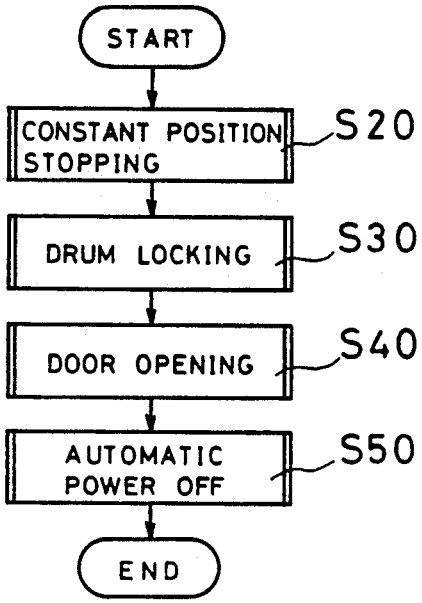
Figure 18:
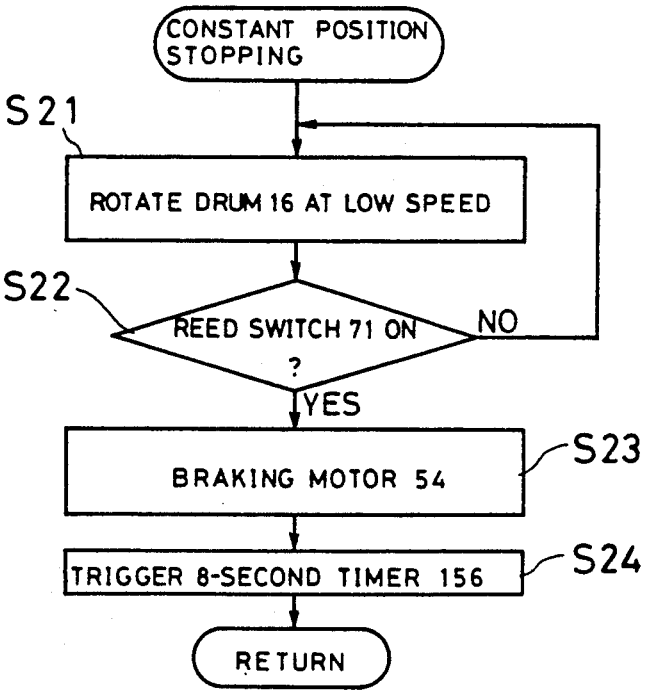
Figure 19:
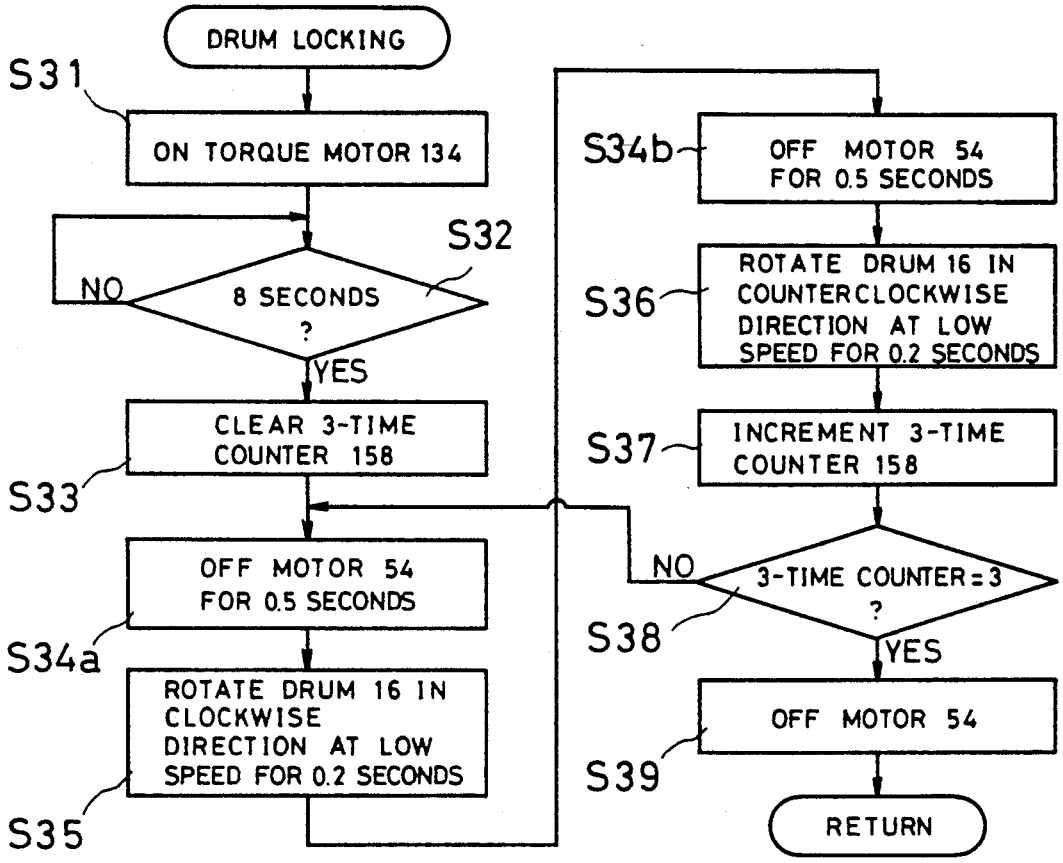

After the constant position stopping routine is executed, in the step S30 of FIG. 17, a drum lock routine shown in FIG. 19 is executed. Therefore, succeedingly to the step S24 of FIG. 18, the step S31 shown in FIG. 19 is executed. More specifically, in the step S31, the microcomputer 140 applies a signal to the torque motor driving circuit 150. Responsively, the torque motor driving circuit 150 turns the torque motor 134 (FIG. 12) on. Then, the shaft 135 of the torque motor 134 is displaced in a direction of the arrow mark H (FIG. 13 or FIG. 14) and the shaft 133 is pulled toward a direction of the arrow mark I by the spring 136. Therefore, the claws 122 and 124 more into the grooves or roots of the gear 60 of the small pulley with gear 58 as shown in FIG.f 14. Thus, the drum 16 is locked.

Thereafter, it is detected that the 8-second timer 156 is timed-up in the step S32, in the step S33, the 3-time counter 158 is cleared.

In the succeeding step S34*a*, the microcomputer 140 turns the motor 54 off for 0.5 seconds. In the next step S35, as similar to the previous step S21 (FIG. 18), the microcomputer 140 rotates the motor 54 for 0.2 seconds at a low speed, and therefore, the drum 16 is rotated in a right direction (a direction of the arrow mark D of FIG. 4) at a low speed.

In the next step S34*b*, as similar to the step S34*a*, the motor 54 is turned-off for 0.5 seconds. Then, in the step S36, as similar to the step S35, the motor 54 is rotated at a low speed, and therefore, the drum 16 is rotated in a left direction (a direction of the arrow mark E of FIG. 4) for 0.2 seconds. Thus, the drum 16 is rotated at a low speed in a right direction and a left direction for extremely short times (0.2 seconds) sandwiching an intermittent time of 0.5 seconds. Therefore, even if the claws 122 and 124 (FIG. 12) ride on the teeth of the gear 60 of the small pulley with gear 58, the claws 122 and 124 surely engage the roots of the gear 60.

The 3-time counter 158 is incremented in the next step S37 and, in the next step S38, it is determined whether or not a counted value of the 3-time counter 158 becomes "3". That is, the left and right intermittent low speed rotation of the drum 16 shown in the steps S34*a* to S36 are repeated three times, whereby the engagement of the claws 122 and 124 to the gear 60 can be surely performed. Then, after "YES" is determined in the step S38, the motor 54 is turned-off in response to a signal from the microcomputer 140.

Figure 20:
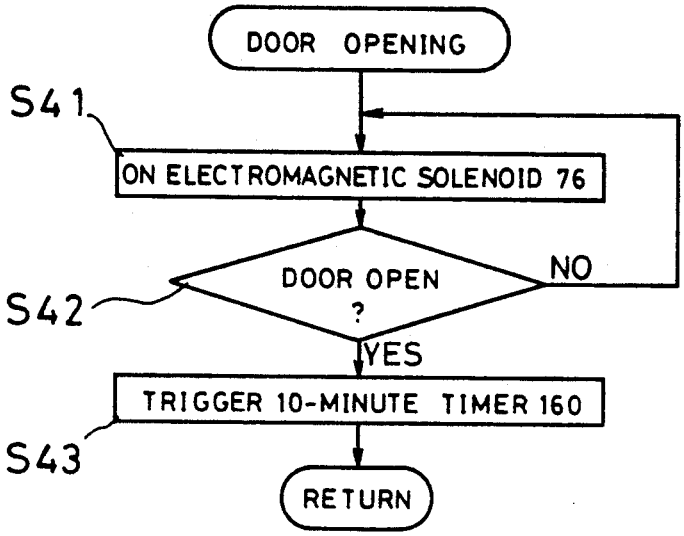

Succeedingly, in the step S40 of FIG. 17, a door opening routine as shown in FIG. 20 is executed. More specifically, in the step S41 shown in FIG. 20, as similar to the previous step S5 of FIG. 16, the microcomputer 140 turns the electromagnetic solenoid 76 on. Then, in the step S42, the microcomputer determines whether or not the door 24 is opened by watching the signals from the microswitches 94 and 110. When the signal from the microswitch 94 is an off-signal and the signal from the microswitch 110 is also an off signal, "YES" is determined in the step S42. Then, in the next step S43, the 10-minute timer 160 is triggered, and the process returns to the main routine of FIG. 17.

Figure 21:
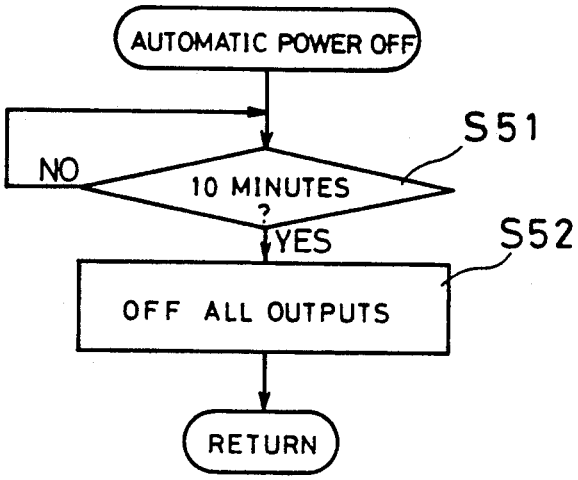

Therefore, the step S50 of FIG. 17, that is, an automatic power-off routine as shown in FIG. 21 is executed. When the time-up of the 10-minute timer 160 is detected in the step S51 of FIG. 21, the microcomputer 140 turns all outputs to the output port 144 off in the next step S52.

After the door 24 is opened, the user enters the wash and the washing agent into the drum 16 through the openings 20 and 46. Then, when a washing key (not shown) included in the operation keys 22*a* (FIG. 15) is operated, a normal operation routine as shown in FIG. 22 can be executed.

Figure 22:
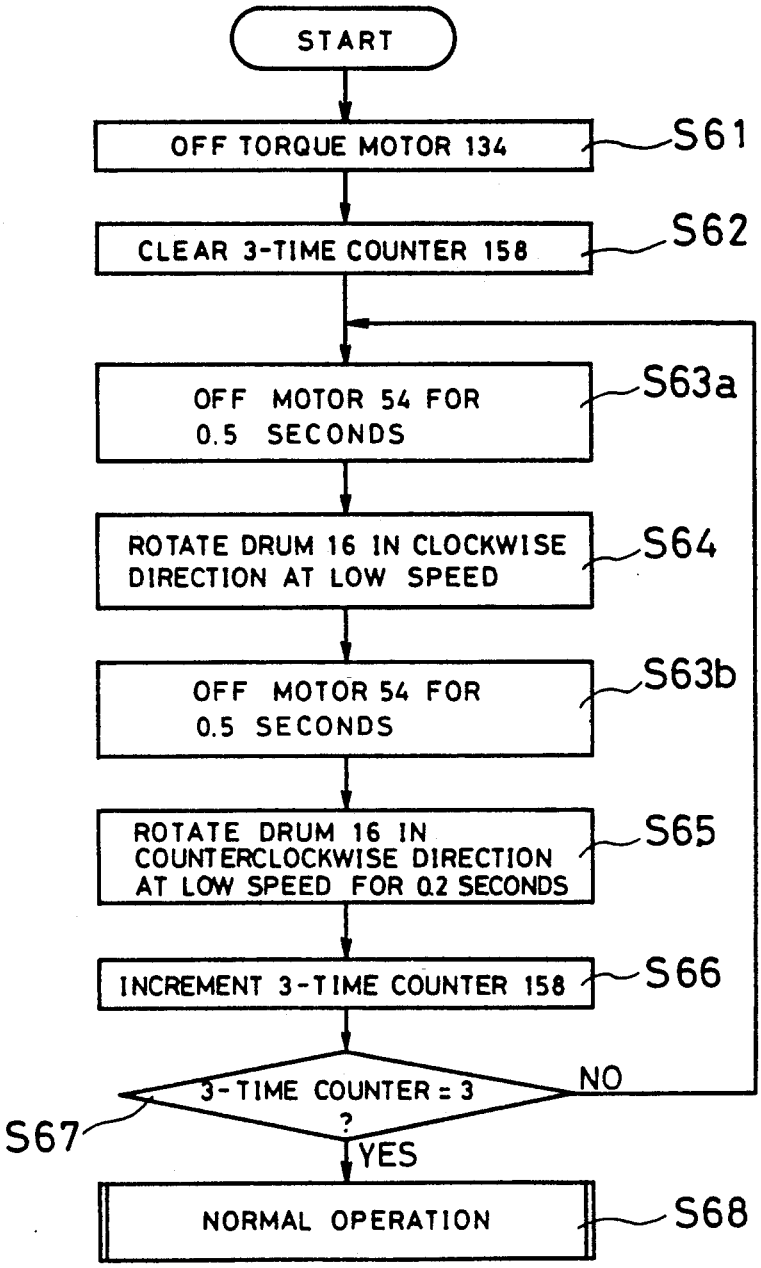

In the first step S61 of FIG. 22, the torque motor 134 of the drum lock mechanism 72 (FIGS. 12–14) is turned-off. More specifically, when the door 24 is automatically opened, as shown in FIG. 17, the drum 16 is locked by the drum lock mechanism 72. Therefore, in the first step S61 of FIG. 22, the microcomputer 140 applies a signal to the torque motor driving circuit 150 to turn the torque motor 134 off. Therefore, the shaft 135 of the torque motor 134 is displaced toward a direction of the arrow mark J (FIG. 13), and the coil spring 136 restores. Responsively, the shaft 133 is displace toward a direction of the arrow mark I so that the claws 122 and 124 are opened as shown in FIG. 13. Therefore, the claws 122 and 124 are disengaged from the grooves or roots of the gear 60, and therefore, the small pulley with gear 58, that is, the drum 16 is brought into a rotatable state.

Thereafter, after the steps S62, S63*a*, S64, S63*b*, S65, S66 and S67 which are respectively the same at the steps S33, S34*a*, S35, S34*b*, S36, S37 and S38 of FIG. 19 are executed, and a normal operation in the step S68 is executed. In a case where a normal operation is started from a state where the drum 16 is locked by the lock mechanism 72, if the load within the drum 16 is one-sided, a rotation force (torque) is applied to the drum 16 and a friction force between the gear 60 and the claws 122 and 124 becomes large, and therefore, the claws 122 and 124 cannot be disengaged with the gear 60 even if the torque motor 134 is turned-off. In order to eliminate such a disadvantage, in this embodiment shown, after the torque motor 134 is turned-off and before a normal operation is started, the drum 16 is swung in left and right directions for a constant number of times (3 times in the embodiment) to surely disengage the claws 122 and 124 from the gear 60.

Figure 23:
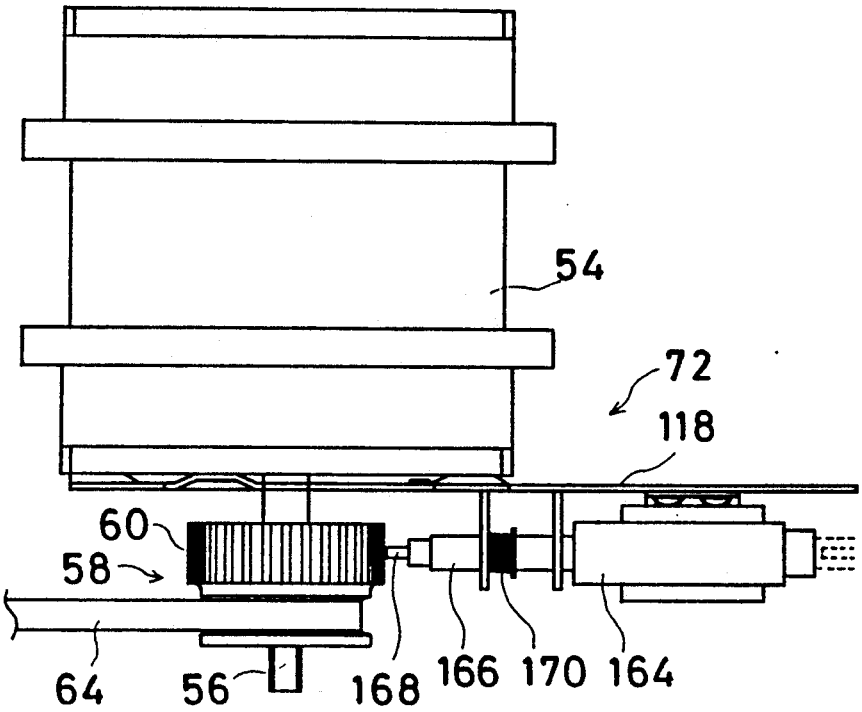
Figure 24:
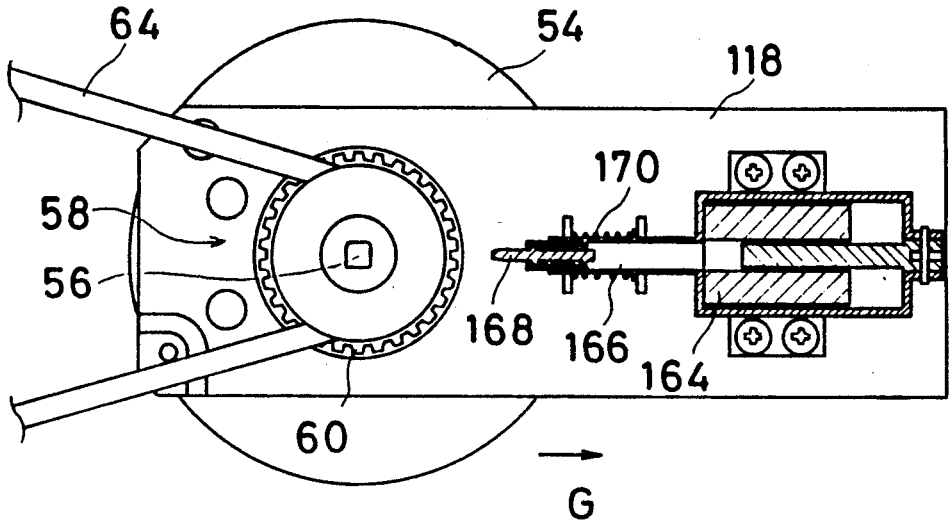
Figure 25:
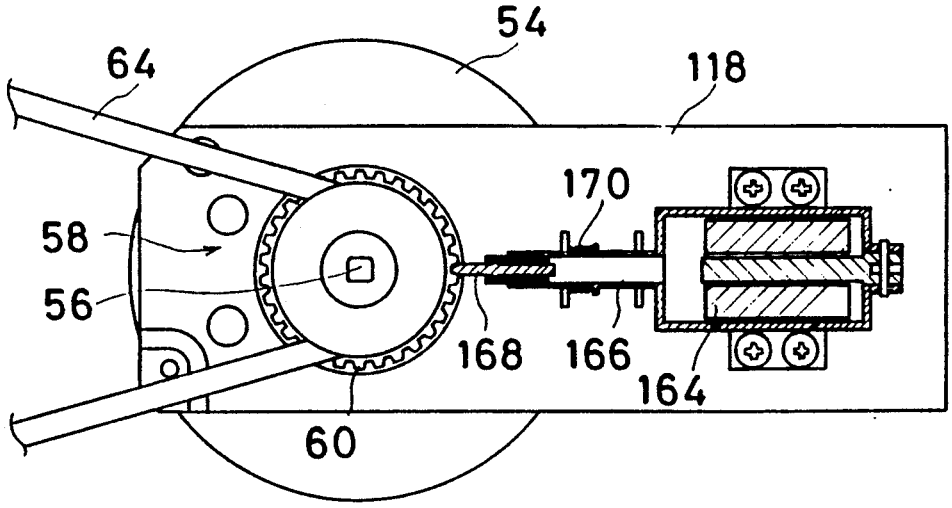

FIGS. 23 to 25 show a modified example of the drum 6 mechanism 72 and, in the modified example, an electromagnetic solenoid 164 is used while the torque motor 134 and the claws 122 and 124 are used in the drum lock mechanism shown in FIG. 12. More specifically, in FIG. 23, the electromagnetic solenoid 164 is secured to the angle 118 and a pin 168 is attached to a plunger 166 of the electromagnetic solenoid 164. Then, the pin 168 is normally pushed by a spring force in a direction of the arrow mark G by a spring 170. By turning the electromagnetic solenoid 164 on or off, as shown in FIG. 24 or FIG. 25, the pin 168 is engaged or disengaged with the groove of the gear 60 of the small pulley with gear 58 so as to lock the small pulley with gear 58, that is, the drum 16.

Figure 26:
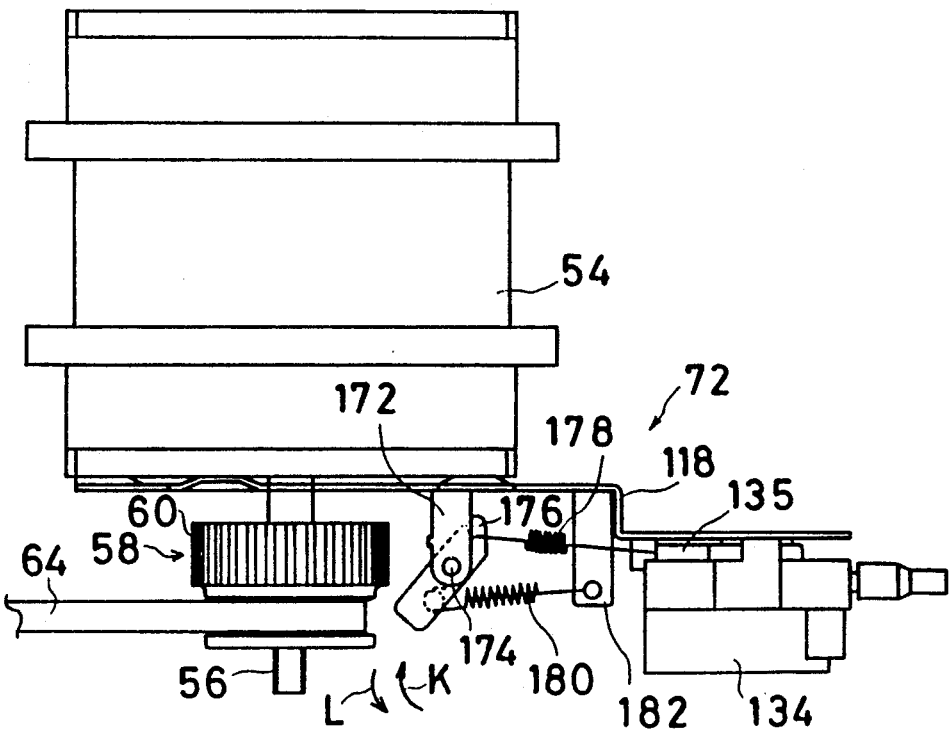
FIG. 26 is a top plan view showing a further modified example of a drum lock mechanism.

FIG. 26 shows a further modified example of the drum lock mechanism 72, wherein a plate 172 is formed on the angle 118, and a swing piece 176 is supported at a tip end of the plate 172 by a shaft 174 in a manner that the same can be swung in a direction of an arrow mark K or in a direction of an arrow mark L. Then, respective ends of springs 178 and 180 are hooked at both sides which sandwiches the shaft 174 of the swing piece 176, and the other end of the spring 178 is hooked to the rotation shaft 135 of the torque motor 134. In addition, the other end of the spring 180 is hooked to a further plate 182 which is formed on the angle 118. Therefore, by turning the torque motor 134 on, the spring 178 pulls the swing piece 176 toward a direction of the arrow mark K. Responsively, the swing piece 176 is rotated, and the other end thereof moves into a groove or root of the gear 60 of the small pulley with gear 58, whereby the small pulley with gear 58, that is, the drum 16 can be locked. If the torque motor 134 is turned-off, the swing piece 172 pulled by the spring 180 and the same becomes in parallel with a peripheral surface of the gear 60 and is disengaged with the gear 60. Therefore, the lock of the drum 16 can be released.

In a case where the electromagnetic solenoid 164 is used instead of the torque motor 134 as shown in Figs. 23 to 25, since the electromagnetic solenoid 164 having an operation speed faster than that of the torque motor 134, for example, the 0.5-second timer 154 can be used instead of the 8-second timer 156 of the step S24 in FIG. 18 and the step S32 in FIG. 19.

Furthermore, in order to prevent the lid of the drum 16 from being forgotten to be closed, as shown in FIG.

Figure 27:
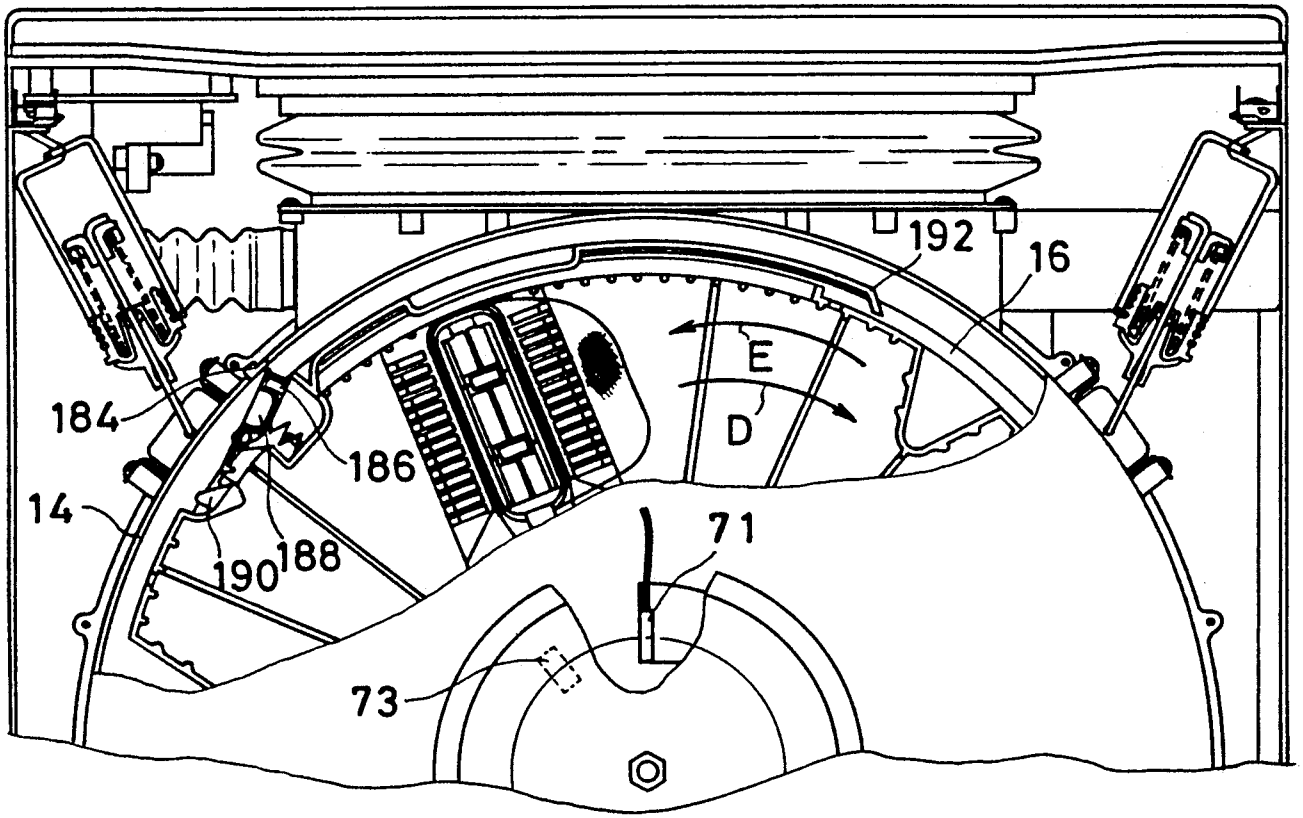
FIG. 27 is an enlarged illustrative view showing a major portion of a mechanism for detecting an opening or closing of a drum lid.

3 and FIG. 27, a reed switch 184 is attached at a portion of the outer tub 14, and a magnet 186 which acts on the reed switch 184 is provided at one end of an arm 188 being secured to the outer peripheral of the drum 16. The arm 188 is pushed by a spring force of a spring so that the same can be engaged with a claw 190 which is provided on the outer peripheral of the drum 16. That is, when a drum lid 192 is completely closed as shown in FIG. 3, the arm 188 engages with the claw 190 and, when the drum cover 192 is opened as shown in FIG. 27, the engagement between the arm 188 and the claw 190 is released.

Now, with reference to FIGS. 15 and 28, a detection of the drum lid 192 being forgotten to be closed in executing a normal operation (for example, washing operation) will be described.

Figure 28:
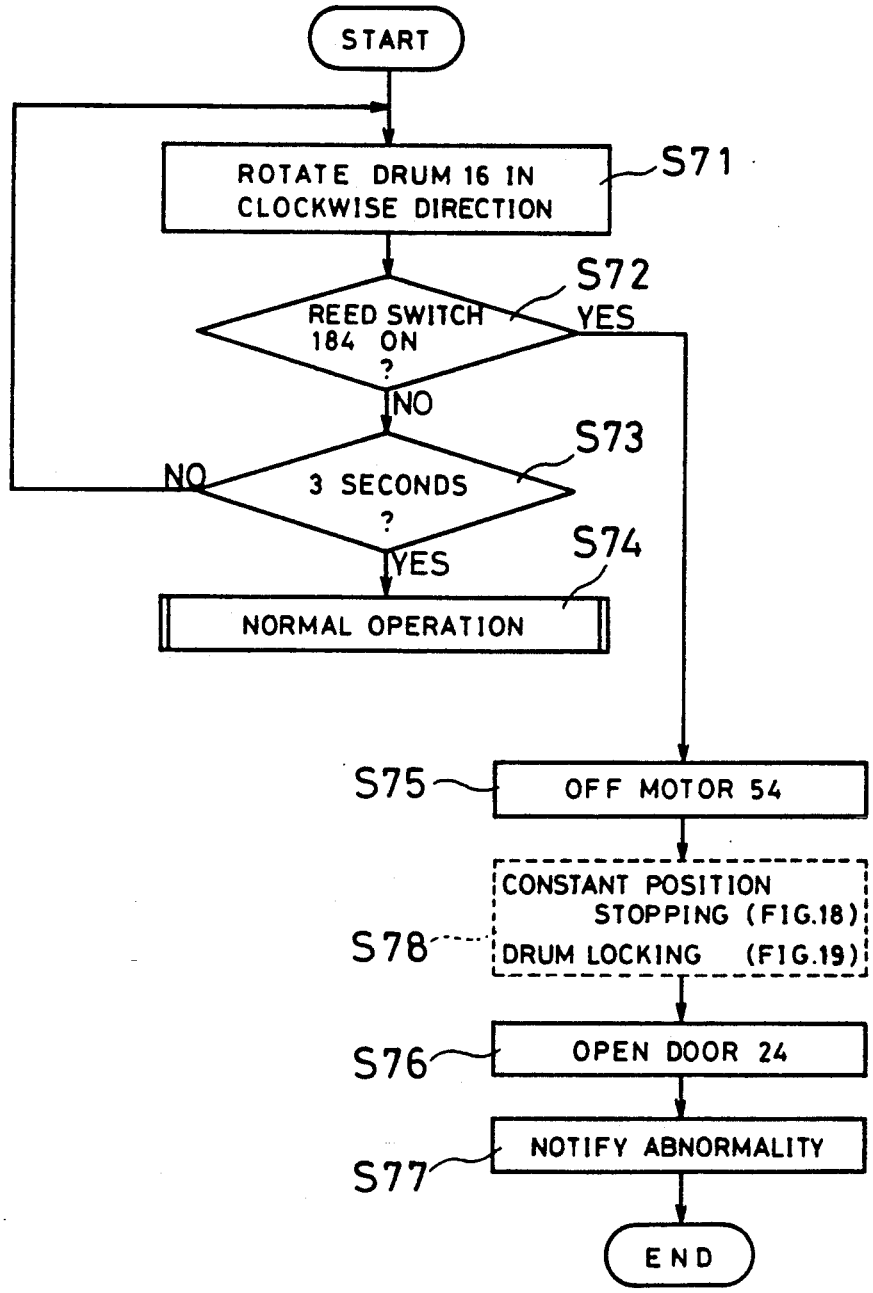
FIG. 28 is a flowchart showing an operation for detecting an unclosing of a drum lid.

In the first step S71 of FIG. 28, succeedingly to a start of the operation, the microcomputer 140 controls the motor driving circuit 146 to rotate the motor 54, whereby the drum 16 is rotated in a clockwise direction. In the succeeding step S72, the microcomputer 140 determines whether or not above described reed switch 184 is turned-on. If the reed switch 184 is turned-off, the drum lid 192 is completely closed. More specifically, if the drum lid 192 is completely closed, the arm 188 engages with the claw 190 as shown in FIG. 3, and therefore, the magnet 186 is separated from the reed switch 184 so that the reed switch 184 cannot be turned-on. If the drum lid 192 is opened as shown in FIG. 27, the engagement of the arm 188 and the claw 190 is released, and therefore, the arm 188 is inclined, and thus, the magnet 186 approaches the outer tub 14, and therefore, the reed switch 184 is turned-on.

When "NO" is determined in the step S72, that is, in a case where the drum lid 192 is completely closed, the microcomputer 140 determines whether or not a time of 3 seconds lapse in the next step S73. To this end, a 3-second timer 194 is assigned in the RAM of the microcomputer 140 as shown in FIG. 15. Then, 3 seconds lapse, the process enters in the normal operation in the step S74.

When "YES" is determined in the previous step S72, that is, in a case where the drum lid 192 is opened, the microcomputer 140 turns the motor 54 off in the step S75 and opens the door 24 (FIG. 1) in the step S76. In order to open the door 24 as described above, the microcomputer 140 applies a signal to the solenoid driving circuit 148 (FIG. 15) to turn the electromagnetic solenoid 76 on. Lastly, in the step S77, a display or buzzer (not shown) included in the operation panel 22 is driven to notify an abnormal state.

In addition, when the drum lid 192 is not completely closed, in order to stop the drum at a predetermined position before the door 24 is opened, the step S78 shown in FIG. 27 may be executed. More specifically, by executing the constant position stopping routine shown in FIG. 18 and the drum lock routine shown in FIG.d 19 as described above, after the drum 16 is stopped at a constant position, the door 24 may be opened.

Furthermore, in the above described embodiments, a combination of the reed switch 71 and the magnet 73 is used to stop the drum 16 at a constant position and lock the same. In this case, the reed switch 71 is arranged at a right overhead as shown in FIG. 4 in the embodiment; however, in a case where the torque motor 134 not but the solenoid 164 (FIG. 23) is utilized for locking the drum 16, since it takes a time until the torque motor 134 completely operates, by computing such a delay time in advance, a position of the reed switch 71 may be arranged to be deviated by a distance being equal to the delay time in a reverse direction of a rotation direction to deviate a timing at a brake is applied by the direct current motor 54 before the predetermined stopping position.

In addition, in order to increase an accuracy of the drum stopping position, two or three reed switches may be used. When two reed switches 71 are used, the two reed switches are provided so as to sandwich the predetermined stopping position and, in the case where three reed switches 71 are used, two reed switches sandwiching the predetermined stopping position and one reed switch at the predetermined stopping position may be arranged. In the former case, when one of the reed switches is turned-on, the drum 16 is rotated in a reverse direction and, if the both reed switches are turned-on, the brake is applied to the motor 54, and the drum lock mechanism 72 is operated during a time when such operations are repeated. In the latter case, if one of the reed switches sandwiching the stopping position is turned-on, a rotation direction of the drum 16 is made to reverse and, if the reed switch at the stopping position is turned-on, the brake is applied by the motor 54, and the drum lock mechanism 72 is operated during a time when such operations are repeated.

In addition, other than a combination of such reed switch(es) and the magnet, other arbitrary sensors, for example an optical sensor or the like may be utilized.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A drum-type washing machine, comprising:

a drum rotatably supported within a frame by a rotation shaft and having an opening for entering or taking-out wash;

a motor having a rotating output shaft for applying rotation power to said drum;

a reduction mechanism including a plurality of power transmission elements for transmitting the rotation of said motor output shaft to the rotation shaft of said drum at a reduced speed, said plurality of power transmission elements including a pulley and gear secured to said motor output shaft; and means for engaging with a root of said gear to lock said drum at a predetermined position.

2. A drum-type washing machine in accordance with claim 1, further comprising a spring for pushing by a spring force said engaging means so that said engaging means is normally released from said root of said gear, and second engaging means for engaging said engaging means with said root of said gear against said spring which the drum is to be locked.

3. A drum-type washing machine in accordance with claim 1, further comprising first rotating means for rotating said drum for a short time in right and left directions when said drum is locked by said engaging means and said gear.

4. A drum-type washing machine in accordance with claim 1, further comprising first releasing means for releasing a locked state of said drum by said engaging means and said gear.

5. A drum-type washing machine in accordance with claim 4, further comprising second rotating means for rotating said drum for a short time in right and left directions when a normal operation is started after a locked state of said drum is released by said first releasing means.

6. A drum-type washing machine in accordance with claim 1, further comprising an opening formed on an upper surface of said frame, a door for opening or closing said opening, and a door lock mechanism for locking said door in a state where the same is closed.

7. A drum-type washing machine in accordance with claim 6, further comprising second releasing means for releasing a locked state of said door by said door lock mechanism.

8. A drum-type washing machine in accordance with claim 7, further comprising means for acting on said engaging means to make said drum in a locked state when said locked state of said door is released by said second releasing means.

9. A drum-type washing machine, comprising:

a drum rotatably supported within a frame by a rotation shaft and having an opening for entering or taking-out wash;

a motor having a rotating output shaft and for applying rotation power to said drum;

a reduction mechanism including a plurality of power transmission elements for transmitting the rotation of said motor output shaft to the rotation shaft of said drum with a reduced speed;

means for stopping the rotation of said drum; and a drum lock mechanism for acting on a power transmission element of said reduction mechanism next to said motor output shaft and for locking said drum after said rotation of said drum is stopped.

10. A drum-type washing machine in accordance with claim 9, further comprising a position sensor for sensing a position of said drum, said stopping means being responsive to a signal from said position sensor for stopping the rotation of said drum.

11. A drum-type washing machine, comprising:

a drum rotatably supported within a frame by a rotation shaft and having an opening for entering or taking-out wash;

a motor having a rotating output shaft and for applying rotation power to said drum;

a reduction mechanism including a plurality of power transmission elements for transmitting the rotation of said motor output shaft to the rotation shaft of said drum with a reduced speed;

stop command means for generating a stop command for stopping a rotation of said drum;

means responsive to said stop command for lowering the rotation speed of said motor;

a position sensor for sensing a position of said drum;

means responsive to a signal from said position sensor for stopping the rotation of said drum; and a drum lock mechanism for acting on a power transmission element of said reduction mechanism next to said motor output shaft and for locking said drum after said rotation of said drum is stopped.

12. A drum-type washing machine as in claim 1 wherein said frame has an opening, and further comprises means for operating said engaging means to lock the drum with its opening at a position aligned with the opening of the frame to permit the entering or taking out of the wash through both said openings.

* * * * *